US011519286B2

(12) United States Patent
Pulanecki

(10) Patent No.: US 11,519,286 B2
(45) Date of Patent: Dec. 6, 2022

(54) SEALING ASSEMBLY AND SEALING MEMBER THEREFOR WITH SPLINE SEAL RETENTION

(71) Applicant: General Electric Company, Schenectady, NY (US)

(72) Inventor: Mariusz Robert Pulanecki, Warsaw (PL)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/169,664

(22) Filed: Feb. 8, 2021

(65) Prior Publication Data

US 2022/0243602 A1 Aug. 4, 2022

(51) Int. Cl.
*F01D 11/00* (2006.01)
*F01D 11/08* (2006.01)

(52) U.S. Cl.
CPC ..... *F01D 11/08* (2013.01); *F01D 11/001* (2013.01); *F01D 11/005* (2013.01); *F05D 2220/32* (2013.01); *F05D 2230/60* (2013.01); *F05D 2240/55* (2013.01)

(58) Field of Classification Search
CPC ..... F01D 11/005; F01D 11/006; F01D 11/001
See application file for complete search history.

(56) References Cited

U.S. PATENT DOCUMENTS

| | | | | |
|---|---|---|---|---|
| 7,575,415 | B2 * | 8/2009 | Drerup | F01D 11/005 29/889.22 |
| 8,308,428 | B2 | 11/2012 | Bridges, Jr. et al. | |
| 8,376,697 | B2 | 2/2013 | Wiebe et al. | |
| 8,845,284 | B2 * | 9/2014 | Farrell | F01D 11/001 415/173.7 |

(Continued)

FOREIGN PATENT DOCUMENTS

| | | | |
|---|---|---|---|
| EP | 0147354 | A1 | 4/1984 |
| EP | 0374079 | A1 | 6/1989 |
| EP | 2048328 | A2 | 8/2008 |

OTHER PUBLICATIONS

EP Patent Application No. 22152813.6, European Search Report and Opinion dated Jun. 15, 2022, 508694-EP-6, 7 pgs.

*Primary Examiner* — Woody A Lee, Jr.
*Assistant Examiner* — Wesley Le Fisher
(74) *Attorney, Agent, or Firm* — James Pemrick; Charlotte Wilson; Hoffman Warnick LLC

(57) ABSTRACT

A sealing assembly includes a plurality of sealing members configured to be located circumferentially adjacent one another between adjacent rotating blade stages in a turbine. The sealing members include axially extending sealing portions having spline seal slots defined in opposing slash faces thereof. The slots are structured to allow insertion of a spline seal into facing slots on adjacent sealing members when the sealing members are in an axially offset position, and to retain the spline seal in the facing slots when the sealing members are moved to an operative axial position.

(Continued)

The slots may include spline seal-retaining seats therein to properly position and retain the spline seal. The sealing members allow easy assembly of the sealing assembly with proper positioning of the spline seal, and without damaging the spline seal or adjacent structure. A method assembling the sealing assembly is also disclosed.

15 Claims, 15 Drawing Sheets

(56) References Cited

U.S. PATENT DOCUMENTS

| | | | | |
|---|---|---|---|---|
| 9,404,376 | B2 | 8/2016 | Potter et al. | |
| 9,540,940 | B2 * | 1/2017 | Liotta | F01D 11/001 |
| 9,890,653 | B2 | 2/2018 | Samudrala et al. | |
| 9,909,439 | B2 * | 3/2018 | Bluck | F01D 11/006 |
| 10,337,345 | B2 * | 7/2019 | Samudrala | F01D 5/12 |
| 11,156,098 | B2 * | 10/2021 | Khoun | F01D 9/042 |
| 2012/0321437 | A1 * | 12/2012 | Hafner | F01D 11/001 415/68 |
| 2013/0264779 | A1 | 10/2013 | Hafner | |
| 2016/0153302 | A1 | 6/2016 | Samudrala et al. | |
| 2019/0162073 | A1 * | 5/2019 | Tyagi | F01D 11/008 |

* cited by examiner

SEALING ASSEMBLY AND SEALING MEMBER THEREFOR WITH SPLINE SEAL RETENTION

TECHNICAL FIELD

The disclosure relates generally to turbomachines, and more particularly, to a sealing assembly and sealing members therefor with spline seal slots in slash faces that provide for spline seal insertion and retention.

BACKGROUND

The main flow path of a turbine is designed to confine the main working fluid as it flows through the turbine and over rotating blade stages of the turbine. One mechanism to confine the main working fluid includes a sealing assembly, sometimes referred to as near flow path seal (NFPS), between adjacent rotating blade stages. The sealing assembly interacts with an inner radial surface of a nozzle to prevent escape of the main working fluid. The sealing assembly includes a number of sealing members arranged in a circumferential arrangement about the rotor between adjacent rotating blade stages. Each sealing member provides an axially extending sealing surface between the rotating blade stages that collectively abut one another to prevent the main working fluid from escaping between turbine blade rotor stages. One challenge with the seal assemblies is providing sufficient sealing between adjacent sealing members. Typically, each sealing member includes a slot defined in a circumferential facing slash face thereof to receive a spline seal, also known as a feather seal. The spline seals seal a radially inner area from a radially outer area. Spline seals are difficult to assemble with the sealing members without damaging the spline seal, the sealing assembly and/or adjacent structure. For example, the sealing member's position may be adjusted during assembly in a manner that damages the spline seals. Alternatively, the process of assembling the sealing members can cause the spline seals to be removed, or incorrectly positioned. Disassembly of the sealing members may be necessary to replace or repair a spline seal that is damaged, or mis-positioned.

BRIEF DESCRIPTION

All aspects, examples and features mentioned below can be combined in any technically possible way.

An aspect of the disclosure provides a sealing member for a sealing assembly including a plurality of sealing members configured to be located adjacent one another between adjacent rotating blade stages of a turbine, wherein the sealing member comprises: a seal base including a securing mechanism operative to secure to an inter-stage support structure; an axially extending sealing portion coupled to the seal base, the axially extending sealing portion having a first axial end and an opposing, second axial end, and a first slash face and an opposing second slash face, wherein each slash face extends between the first axial end and the opposing, second axial end; a first spline seal slot defined in the first slash face, the first spline seal slot including a first spline seal-entry opening defined through the first axial end of the axially extending sealing portion; and a second spline seal slot defined in the second slash face, the second spline seal slot including a second spline seal-entry opening defined through the first axial end of the axially extending sealing portion, wherein the first spline seal-entry opening in the first slash face is at a first radial position that is different than a second radial position of the second spline seal-entry opening in the second slash face, and wherein the first spline seal slot and the second spline seal slot of adjacent sealing members cooperate to retain a spline seal therein in an operating position thereof.

Another aspect of the disclosure includes any of the preceding aspects, and the first spline seal slot in the first slash face includes a closed end at the second axial end of the axially extending sealing portion.

Another aspect of the disclosure includes any of the preceding aspects, and the second spline seal slot in the second slash face includes a spline seal passthrough opening defined through the second axial end of the axially extending sealing portion. The spline seal passthrough opening is radially aligned with the first spline seal slot defined in the first slash face.

Another aspect of the disclosure includes any of the preceding aspects, and the first spline seal slot in the first slash face includes a first spline seal end-retaining seat in the first axial end of the axially extending sealing portion, and a second spline seal end-retaining seat in the second axial end of the axially extending sealing portion, wherein the first axial opening is contiguous with the first spline seal end-retaining seat, and wherein the second spline seal slot in the second slash face includes a third spline seal end-retaining seat in the second axial end of the axially extending sealing portion.

Another aspect of the disclosure provides a sealing assembly, comprising: a plurality of first sealing members configured to be located adjacent one another between adjacent rotating blade stages in a turbine, wherein each first sealing member includes: a first seal base including a first securing mechanism operative to secure the sealing member to an inter-stage support structure; a first axially extending sealing portion coupled to the first seal base, the first axially extending sealing portion having a first axial end and an opposing, second axial end, and a first slash face and an opposing second slash face, wherein each slash face extends between the first axial end and the opposing, second axial end; a first spline seal slot defined in the first slash face, the first spline seal slot including a first spline seal-entry opening defined through the first axial end of the first axially extending sealing portion; and a second spline seal slot defined in the second slash face, the second spline seal slot including a second spline seal-entry opening defined through the first axial end of the first axially extending sealing portion, wherein the first spline seal-entry opening in the first slash face is at a first radial position that is different than a second radial position of the second spline seal-entry opening in the second slash face, and wherein the first spline seal slot and the second spline seal slot of adjacent sealing members cooperate to retain a spline seal therein in an operating position.

Another aspect of the disclosure includes any of the preceding aspects, and the first spline seal slot in the first slash face includes a closed end at the second axial end of the axially extending sealing portion.

Another aspect of the disclosure includes any of the preceding aspects, and the second spline seal slot in the second slash face includes a spline seal passthrough opening defined through the second axial end of the axially extending sealing portion, wherein the spline seal passthrough opening is radially aligned with the first spline seal slot defined in the first slash face.

Another aspect of the disclosure includes any of the preceding aspects, and the first spline seal slot in the first slash face includes a first spline seal end-retaining seat in the first axial end of the first axially extending sealing portion, and a second spline seal end-retaining seat in the second axial end of the first axially extending sealing portion, wherein the first axial opening is contiguous with the first spline seal end-retaining seat.

Another aspect of the disclosure includes any of the preceding aspects, and the second spline seal slot in the second slash face includes a third spline seal end-retaining seat in the second axial end of the first axially extending sealing portion.

Another aspect of the disclosure includes any of the preceding aspects, and the second spline seal-entry opening in the second slash face couples to a remainder of the second spline seal slot defined in the second slash face by a contiguous curved slot portion defined in the second slash face.

Another aspect of the disclosure includes any of the preceding aspects, and the contiguous curved slot portion is circumferentially aligned with the third spline seal end-retaining seat in the second axial end of the first axially extending sealing portion.

Another aspect of the disclosure includes any of the preceding aspects, and further comprises a spline seal within spline seal slots of adjacent sealing members, each spline seal including a planar body having opposing ends angled relative to the planar body in a relaxed state, wherein at least one of the opposing ends is retained in one of the spline seal end-retaining seats in the relaxed state.

Another aspect of the disclosure includes any of the preceding aspects, and the first spline seal-entry opening in the first slash face couples in a linearly contiguous manner with a remainder of the first spline seal slot defined in the first slash face.

Another aspect of the disclosure includes any of the preceding aspects, and further comprises: a second sealing member configured to be located adjacent one of the first sealing members, the second sealing member including: a second seal base including a second securing mechanism operative to secure to the inter-stage support structure; a second axially extending sealing portion coupled to the second seal base, the second axially extending sealing portion having a third axial end and an opposing, fourth axial end, and a third slash face and an opposing fourth slash face, wherein each of the third and fourth slash faces extends between the third axial end and the opposing, fourth axial end; and a third spline seal slot defined in the third slash face, the third spline seal slot including a third spline seal-entry opening defined through the third axial end of the second axially extending sealing portion; a fourth spline seal slot defined in the fourth slash face, the fourth spline seal slot including a fourth spline seal-entry opening defined through the third axial end of the second axially extending sealing portion, wherein the third spline seal-entry opening and the fourth spline seal-entry opening are at the first radial position that is different than the second radial position of the second spline seal-entry opening, and wherein one of the third spline seal slot and the fourth spline seal slot cooperates to retain a spline seal therein in an operating position with a respective spline seal slot of the adjacent first sealing member.

Another aspect of the disclosure includes any of the preceding aspects, and further comprises: a third sealing member configured to be located between one of the first sealing members and the second sealing member, the third sealing member including: a third seal base including a third securing mechanism operative to secure to the inter-stage support structure; a third axially extending sealing portion coupled to the third seal base, the third axially extending sealing portion having a fifth axial end and an opposing, sixth axial end, and a fifth slash face and an opposing sixth slash face, wherein each of the fifth and sixth slash faces extends between the fifth axial end and the opposing, sixth axial end; and a fifth spline seal slot defined in the fifth slash face, the fifth spline seal slot including a fifth spline seal-entry opening defined through the fifth axial end of the third axially extending sealing portion; a sixth spline seal slot defined in the sixth slash face, the sixth spline seal slot including a sixth spline seal-entry opening defined through the sixth axial end of the third axially extending sealing portion, wherein the fifth spline seal-entry opening and the sixth spline seal-entry opening are at the second radial position of the second spline seal-entry opening, and wherein one of the fifth spline seal slot and the sixth spline seal slot cooperates to retain a spline seal therein in an operating position with a respective spline seal slot of the adjacent first sealing member.

An aspect of the disclosure provides a method of assembling a plurality of sealing members configured to be located adjacent one another between adjacent rotating blade stages of a turbine, the method comprising: first positioning a first sealing member in an inter-stage support structure in an operative axial position of the plurality of sealing members, wherein the first sealing member includes a first spline seal slot defined in a first slash face thereof, the first spline seal slot including a first spline seal-entry opening defined through a first axial end of a first axially extending sealing portion of the first sealing member; second positioning a second sealing member in the inter-stage support structure in an axial offset position from the operative axial position that is only partially toward the operative axial position of the plurality of sealing members, wherein the second sealing member includes a second spline seal slot defined in a second slash face thereof, the second spline seal slot including a second spline seal-entry opening defined through a second axial end of a second axially extending sealing portion of the second sealing member, wherein the first and second spline seal slots are aligned for receipt of a spline seal therein in the second axially offset position of the second sealing member; inserting a spline seal into the first and second spline seal slots; and third positioning the second sealing member in the inter-stage support structure in the operative axial position of the plurality of sealing members, wherein the third positioning carries the spline seal into the first and second spline seal slots, and retains the spline seal in an operative axial position of the spline seal in at least one spline seal-retaining seat in at least one of the first and second spline seal slots.

Another aspect of the disclosure includes any of the preceding aspects, and further comprises retaining the spline seal in a closed end of the first spline seal slot in the first slash face at a second axial end of the first axially extending sealing portion.

Another aspect of the disclosure includes any of the preceding aspects, and further comprises, in the axially offset position, extending the spline seal through a spline seal passthrough opening defined through a second axial end of the second axially extending sealing portion, wherein the spline seal passthrough opening is radially aligned with the first spline seal slot.

Another aspect of the disclosure includes any of the preceding aspects, and further comprises, in the operative axial position, retaining: a first seal end of the spline seal in: a first spline seal end-retaining seat in the second axial end of the first axially extending sealing portion, and a second spline seal end-retaining seat in the second axial end of the second axially extending sealing portion; and a second seal end of the spline seal in a third spline seal end-retaining seat in the first axial end of the first axially extending sealing portion.

Another aspect of the disclosure includes any of the preceding aspects, and, further comprises: prior to the first positioning, positioning an initiator sealing member in the inter-stage support structure in the operative axial position, the initiator sealing member configured to be positioned adjacent the first sealing member, the initiator sealing member having spine seal slots on opposing slash faces thereof having spline seal entry openings in an axial end of an axially extending seal portion thereof, each of the openings at a first radial position; repeating the second positioning for a number of the second sealing members, one of the second sealing members adjacent the initiator sealing member; and after the repeating the second positioning, positioning a locking sealing member in an axial offset position from the operative axial position that is only partially toward the operative axial position of the plurality of sealing members, the locking sealing member configured to be located between a last one of the second sealing members and the initiator sealing member, the locking sealing member having spine seal slots on opposing slash faces thereof having openings in an axial end of an axially extending seal portion thereof, each of the openings having a different, second radial position than the first radial position; inserting a spline seal into both the first and second spline seal slots of the locking sealing member; and positioning the locking sealing member in the inter-stage support structure in the operative axial position of the plurality of sealing members, wherein the positioning of the locking sealing member positions both spline seals into the spline seal slots of the locking sealing member, and retains the spline seals in the operative axial position of the spline seals in at least one spline seal-retaining seat in at least one of the spline seal slots.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
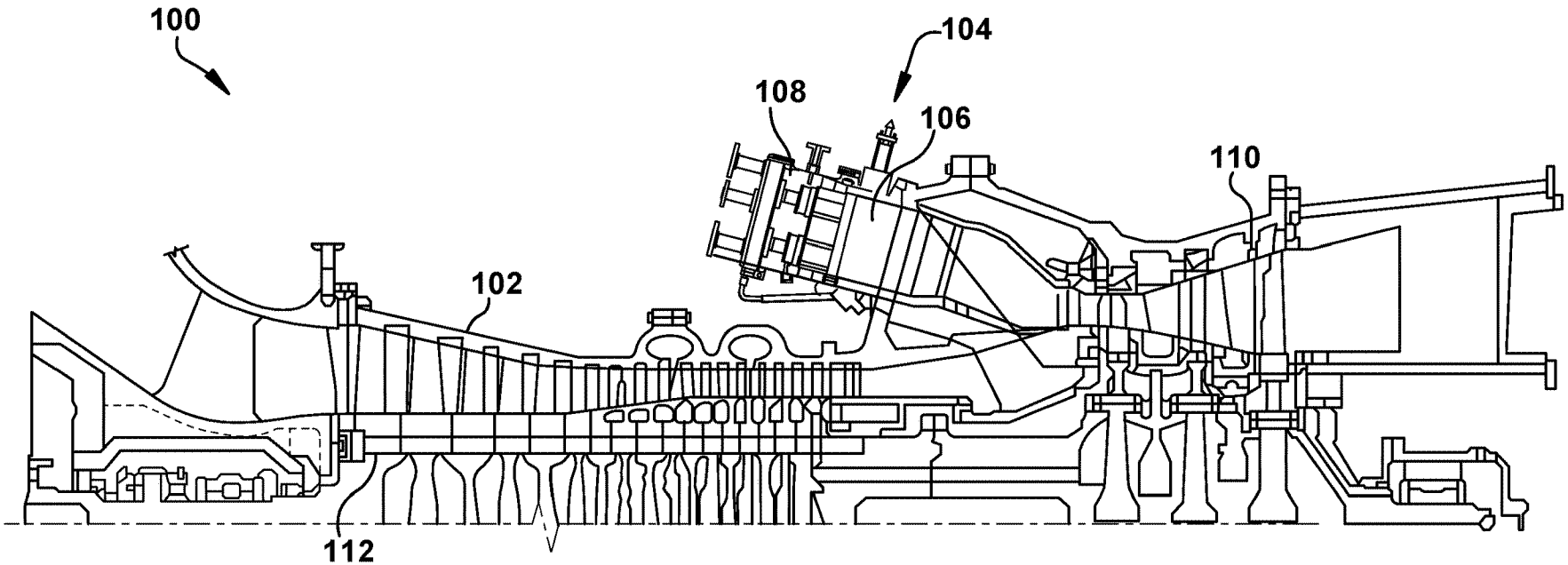
FIG. 1 shows a schematic view of an illustrative turbomachine in the form of a gas turbine system.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within a turbomachine. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow (i.e., the direction from which the flow originates).

It is often required to describe parts that are disposed at differing radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

In addition, several descriptive terms may be used regularly herein, as described below. The terms "first", "second", and "third," may be used interchangeably to distinguish one component from another and are not intended to signify location, order or importance of the individual components.

The terminology used herein has the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a sealing assembly including a plurality of sealing members configured to be located circumferentially adjacent one another between adjacent rotating blade stages in a turbine. The sealing members include axially extending sealing portions having spline seal slots defined in opposing slash faces thereof. The axially extending sealing portions interact to form a complete sealing assembly. The spline seal slots are structured to allow insertion of a spline seal into facing slots on adjacent sealing members when the sealing members are in an axially offset position, and to retain the spline seal in the facing slots when the sealing members are moved to an operative axial position. The slots may include spline seal-retaining seats therein to properly position and retain the spline seals. The sealing members facilitate installing of the sealing assembly with proper positioning of the spline seal, and without damaging the spline seal or adjacent structure. The sealing assembly does not require additional parts or tools compared to conventional systems, and does not require any other changes to the turbine, thus allowing application to both new and older turbines. A method of assembling the sealing assembly will also be described.

FIG. 1 shows a schematic illustration of an illustrative turbomachine 100 in the form of a combustion or gas turbine system. Turbomachine 100 includes a compressor 102 and a combustor 104. Combustor 104 includes a combustion region 106 and a fuel nozzle assembly 108. Turbomachine 100 also includes a turbine 110 and a common compressor/turbine shaft 112 (sometimes referred to as a rotor 112). In one embodiment, GT system 100 is a 7HA.03 engine, commercially available from General Electric Company, Greenville, S.C. The present disclosure is not limited to any one particular GT system and may be implemented in connection with other engines including, for example, the other HA, F, B, LM, GT, TM and E-class engine models of General Electric Company, and engine models of other companies. Furthermore, the present disclosure is not limited to any particular turbomachine, and may be applicable to, for example, steam turbines, jet engines, compressors, turbofans, etc.

In operation, air flows through compressor 102 and compressed air is supplied to combustor 104. Specifically, the compressed air is supplied to fuel nozzle assembly 108 that is integral to combustor 104. Assembly 108 is in flow communication with combustion region 106. Fuel nozzle assembly 108 is also in flow communication with a fuel source (not shown in FIG. 1) and channels fuel and air to combustion region 106. Combustor 104 ignites and combusts fuel. Combustor 104 is in flow communication with turbine assembly 110 for which gas stream thermal energy is converted to mechanical rotational energy. Turbine assembly 110 includes a turbine 111 that rotatably couples to and drives rotor 112. Compressor 102 also is rotatably coupled to rotor 112. In the illustrative embodiment, there is a plurality of combustors 106 and fuel nozzle assemblies 108.

Figure 2:
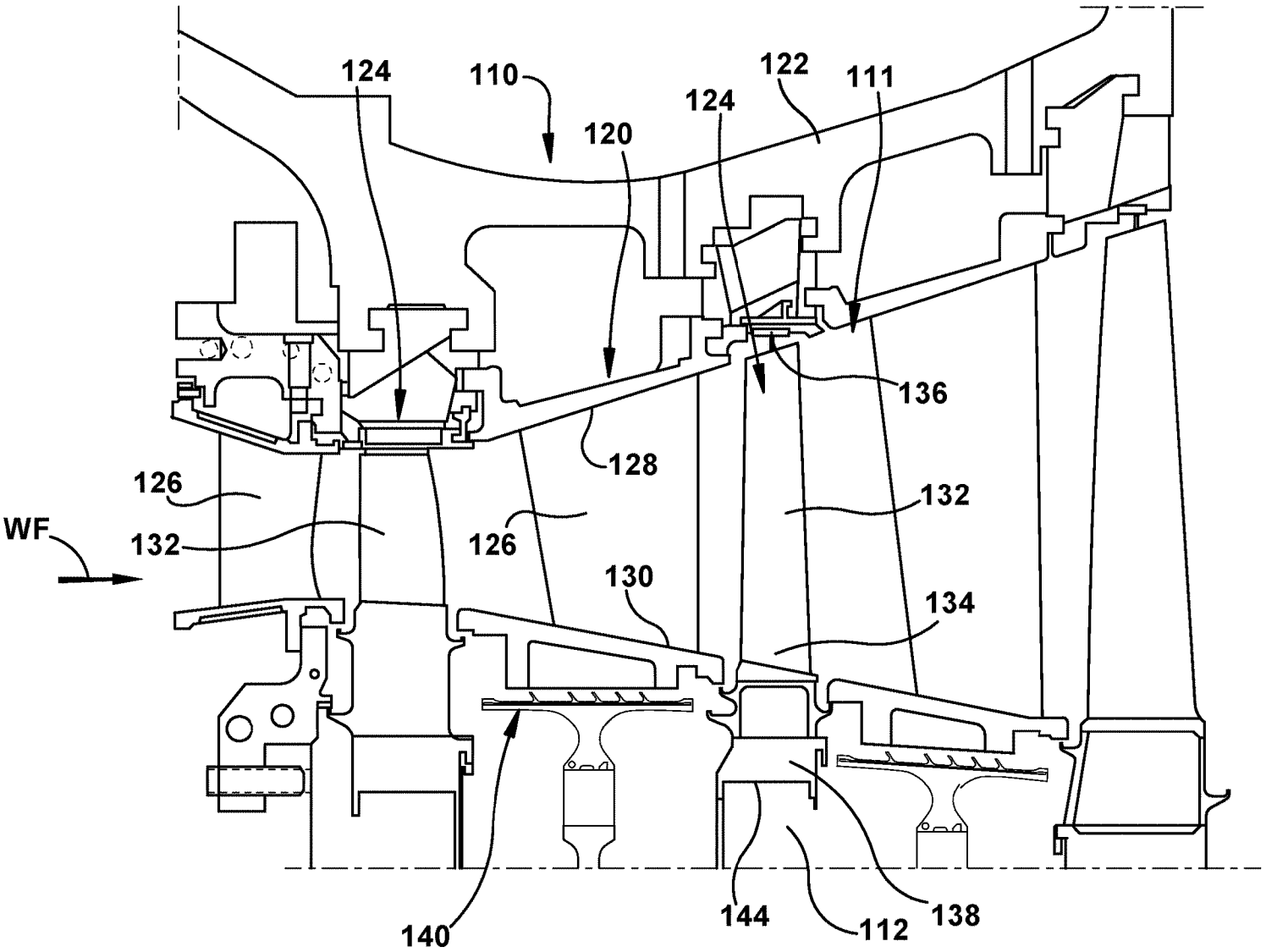
FIG. 2 shows a cross-sectional view of an illustrative gas turbine assembly that may be used with the gas turbine system in FIG. 1.

FIG. 2 shows a cross-sectional view of an illustrative turbine assembly 110 of turbomachine 100 (FIG. 1) that may be used with the gas turbine system in FIG. 1. Turbine 111 of turbine assembly 110 includes a nozzle or vane stage 120 coupled to a stationary casing 122 of turbomachine 100 and axially adjacent a rotating blade stage 124. A nozzle or vane 126 may be held in turbine assembly 110 by a radially outer platform 128 and a radially inner platform 130. Rotating blade stage(s) 124 in turbine assembly 110 includes rotating blades 132 coupled to rotor 112 by a rotor wheel 138 and rotating with the rotor. Rotating blades 132 may include a radially inward platform 134 (at root of blade) coupled to rotor 112 and a radially outward tip shroud 136 (at tip of blade). A sealing assembly 140 is included between rotating blade stages 124, i.e., rotor wheel 138 and rotating blades 132, and forms a rim seal or other airflow path seal. Sealing assembly 140 may form a rim or outer boundary of turbine rotor 112 that separates the main working fluid (such as combustion gas) flow path from interior portions of rotor 112 (including components such as portions of the shaft of rotor 112 and rotor wheels 138). Sealing assembly 140 is configured to prevent fluids from migrating to or from the main working fluid flow path formed by blades 132 and nozzles 126.

Figure 3:
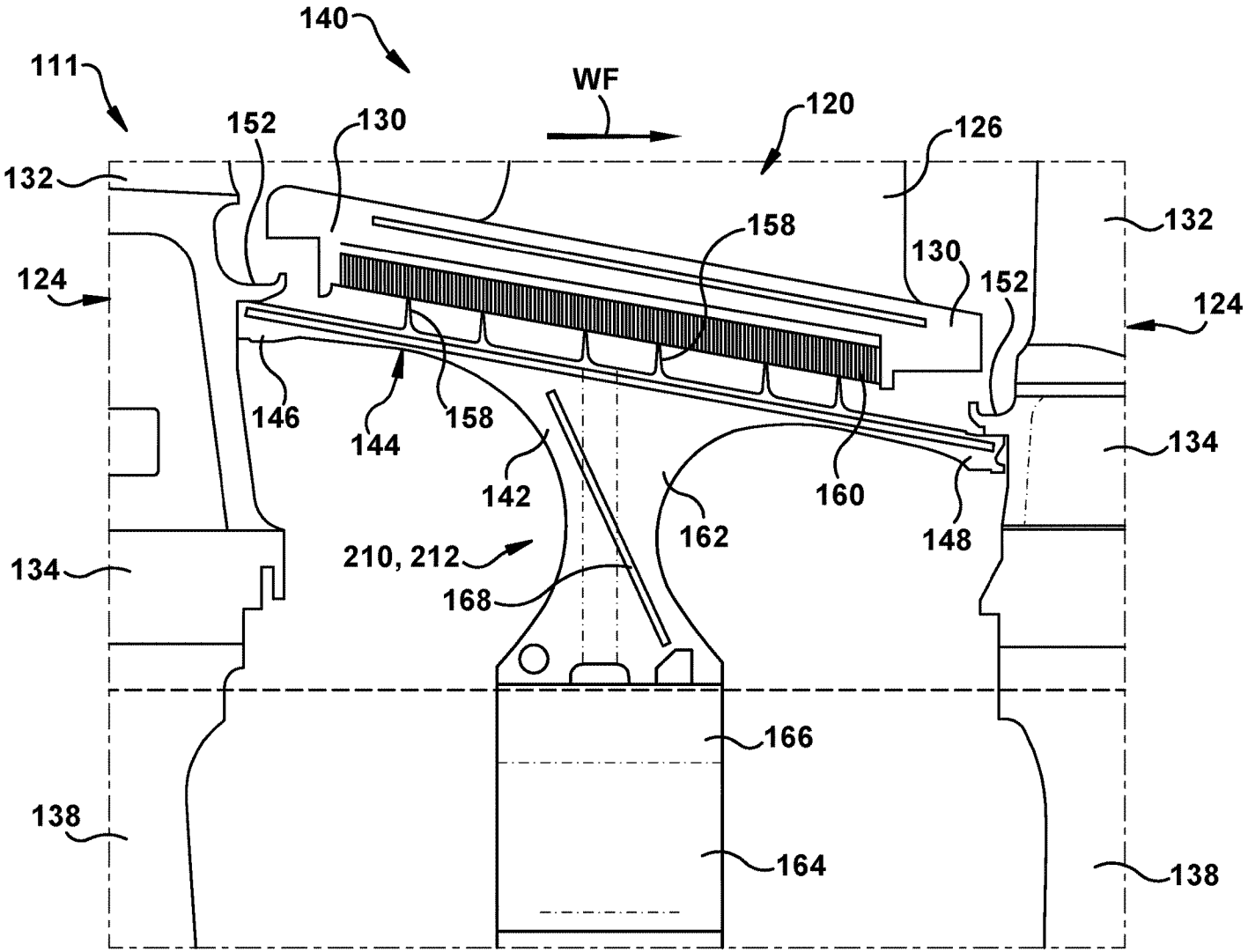
FIG. 3 shows a side cross-sectional view of a portion of a turbine including a sealing assembly including a plurality of sealing members.
Figure 4:
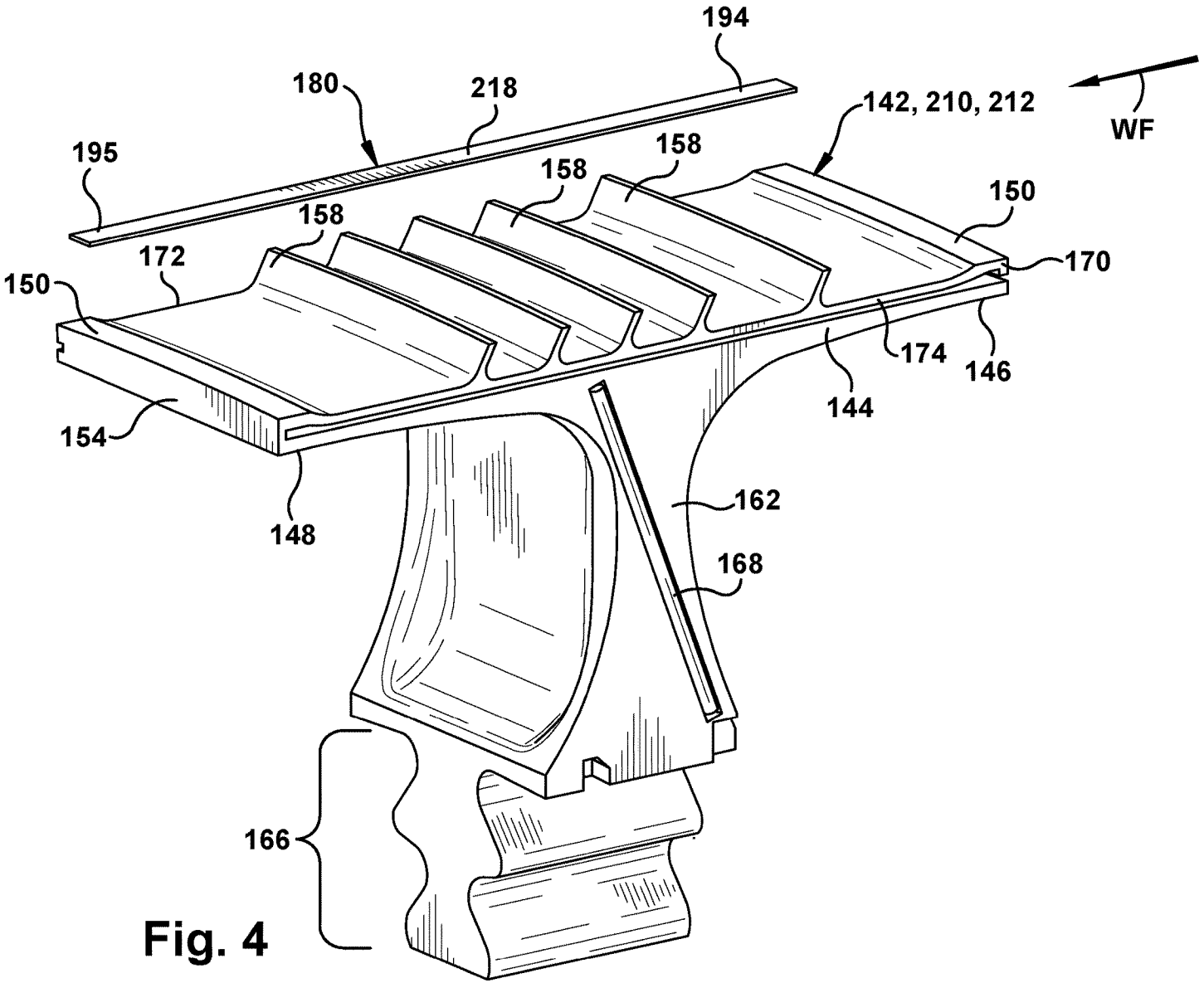
FIG. 4 shows a perspective view of an illustrative sealing member and a spline seal.
Figure 9:
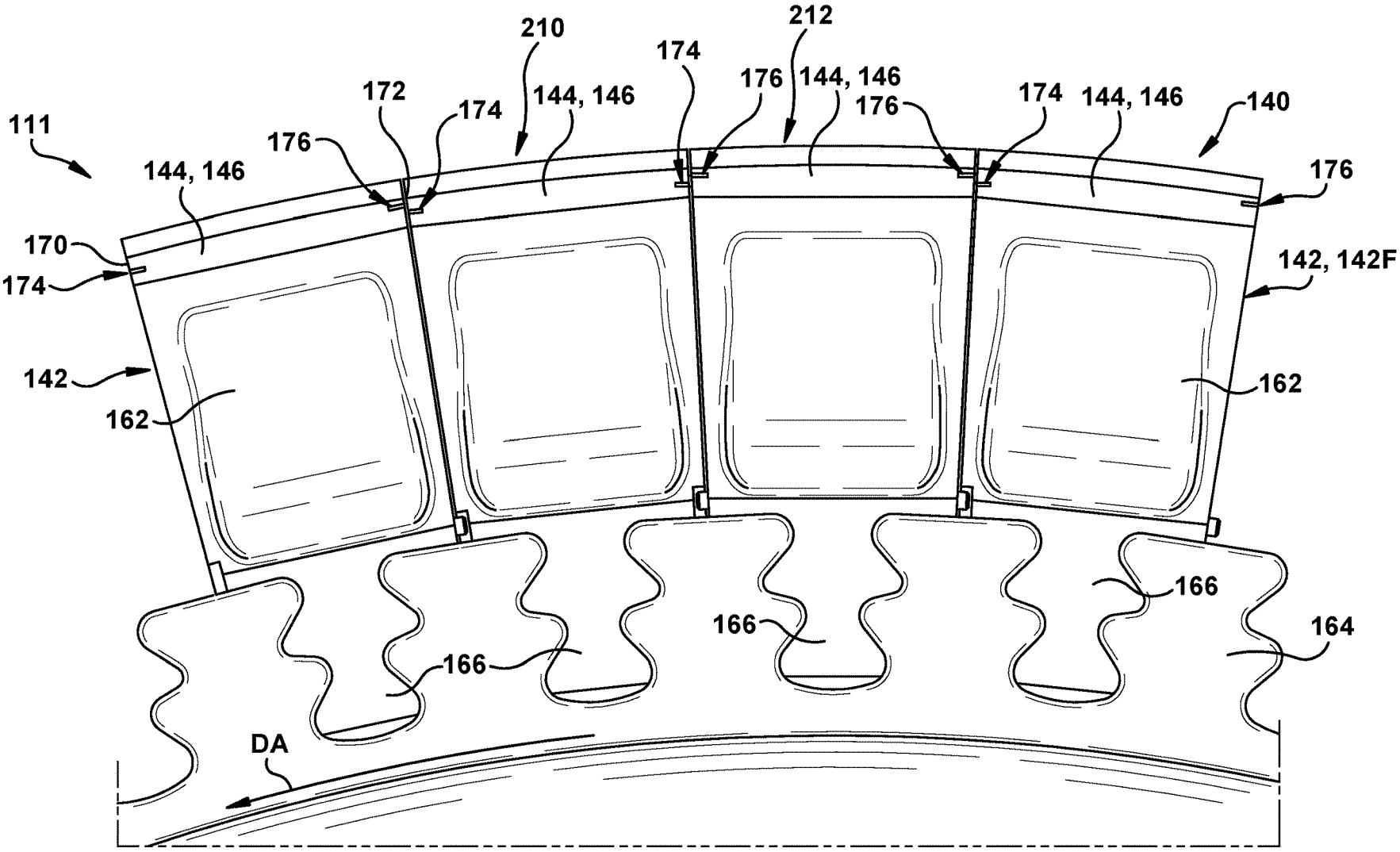
FIG. 9 shows an end view of a forward end portion of a sealing assembly in a turbine.
Figure 11:
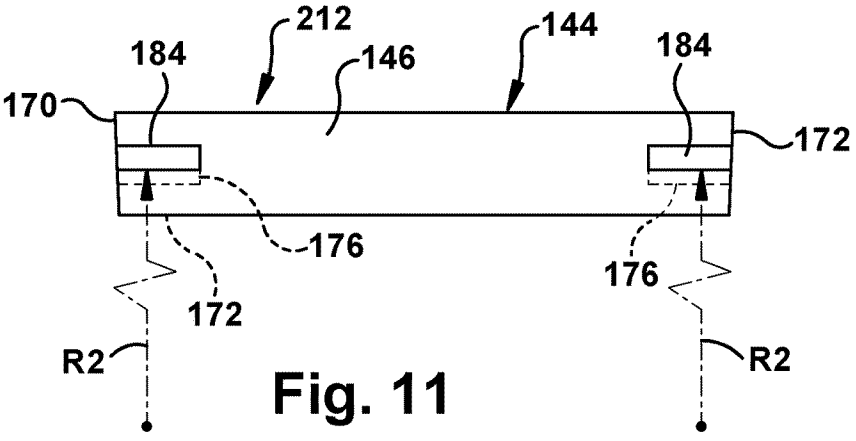
FIG. 11 shows an end view of a forward axial end of an axially extending sealing portion of a locking sealing member.

FIG. 3 shows a side cross-sectional view of a portion of turbine 111 including a sealing assembly 140 including a plurality of sealing members, and FIG. 4 shows a perspective view of a sealing member of FIG. 3. In one embodiment, sealing assembly 140 includes a plurality of sealing members configured to be located adjacent one another between adjacent rotating blade stages 124 of turbine 111. As will be described herein, sealing assembly 140 includes several different types of sealing members. (Note, the sealing member in FIG. 4 is a composite of a number of different types of sealing members 142, 210, 212, described herein). One sealing member is provided to initiate assembly and thus is referred to as an "initiator sealing member" 210 (FIGS. 9, 10), another terminates assembly and locks the sealing members in place, and thus is referred to as a "locking sealing member" 212 (FIGS. 9, 11). However, as will be described, most of the sealing members include what is referred to herein as a "main sealing member" 142. As noted, the sealing members include spline seal slots on opposing slash faces thereof to allow insertion and retaining of a spline seal 180 between adjacent sealing members. The difference between sealing members is based on the spline seal slots that they include on opposing slash faces 170, 172 thereof—out of the two types of spline seal slots used. As will be described, main sealing members 142 include different spline seal slots, initiator sealing member 210 includes one type of the spline seal slots on both slash faces, and locking sealing member 212 includes the other type of spline seal slot on both slash faces. All sealing members 142, 210, 212 may radially contact, and may be radially loaded against, rotating blade stages 124.

Continuing with FIGS. 3 and 4, each sealing member 142, 210, 212 includes one or more generally axially extending portions ("axial sealing portions" or "axially extending sealing portions") 144 coupled to a seal base 162. Axial sealing portions 144 have a first axial end 146 and an opposing, second axial end 148. Axial sealing portions 144 also have a first slash face 170 and an opposing second slash face 172. Each slash face 170, 172 extends between first axial end 146 and opposing, second axial end 148. Slash faces 170, 172 face circumferentially to mate with a respective slash face 172, 170 of an adjacent sealing member 142, 210, 212, as will be further described herein. For purposes of description, first axial end 146 is illustrated as a forward axial end, and second axial end 148 is illustrated as an aft axial end. As described herein, "forward" refers to a leading position relative to a reference position along a working fluid flow path, and "aft" refers to a trailing position relative to a reference position along the fluid flow path, see e.g., arrow WF illustrating a working fluid flow direction. Hereafter, the axial ends will be referenced as forward axial end 146 and aft axial end 148, for clarity. It is emphasized, however, that the axial ends and the structures positioned by reference thereto can be switched without departing from the scope of the disclosure.

In one embodiment, axial sealing portion 144 also includes load surfaces 150 (FIG. 4) located at or proximate to forward axial end 146 and aft axial end 148 and configured to contact and exert an outward radial load against each rotating blade stage 124. For example, load surfaces 150 are configured to contact axially protruding shelves 152 or other protrusions extending axially from rotating blade stages 124. In the example shown in FIG. 3, shelves 152 are disposed at blade shanks or radial inner platforms 134, although shelves 152 may be disposed at any suitable location, such as at selected locations of rotor wheels 138 and blades 132. In one embodiment, a seal is formed by contact between load surfaces 150 and shelves 152, and/or a sealing mechanism, such as a load bar or a wire seal 154 (FIG. 4), disposed at forward end 146 and/or aft end 148.

In one embodiment, axial sealing portion 144 includes radial sealing members configured to contact a part of nozzle stage 120 (FIG. 3). For example, axial sealing portion 144 may include a plurality of seal teeth 158 that are disposed on a radial outer side of axial sealing portion 144 and extend radially outwardly. Seal teeth 158 are configured to seal against a stator surface of nozzle stage 120, for example, an inner nozzle support structure such as radial inner platform 130 (FIG. 3) including an abradable surface 160 (FIG. 3).

Sealing member(s) 142, 210, 212 also include a seal base 162 that is removably attachable to an inter-stage support structure 164, such as a turbine spacer rim structure. In one embodiment, seal base 162 includes a retention mechanism 166 operative to secure sealing member 142 to inter-stage support structure 164. In one embodiment, seal base 162 includes retention mechanism 166 configured to secure sealing member 142, 210, 212 in place in at least substantially radial and tangential directions relative to support structure 164, but allow for axial movement. Retention mechanism 166 is illustrated as an at least substantially axial dovetail, although the retention mechanism is not so limited. Sealing member 142, 210, 212 is not limited to the shapes and configurations described herein, as sealing member 142, 210, 212, axial sealing portion 144, retention mechanism 166, and/or seal base 162, may be shaped as desired, for example, to reduce weight, deflection, leakage and/or stress.

Sealing assembly 140 includes a plurality of sealing members 142, 210, 212 that are configured to be disposed against one another to form a continuous circumferential sealing member. Each of sealing members 142, 210, 212 may include sealing features to control leakage around and/or through rim seal segments. For example, sealing features may include segment seals 168 such as generally axially and/or radially extending spline seals, wire seals or pin seals to form seals between seal bases 162 of adjacent sealing members 142, 210, 212 to lessen fluid flow therebetween.

Figure 5:
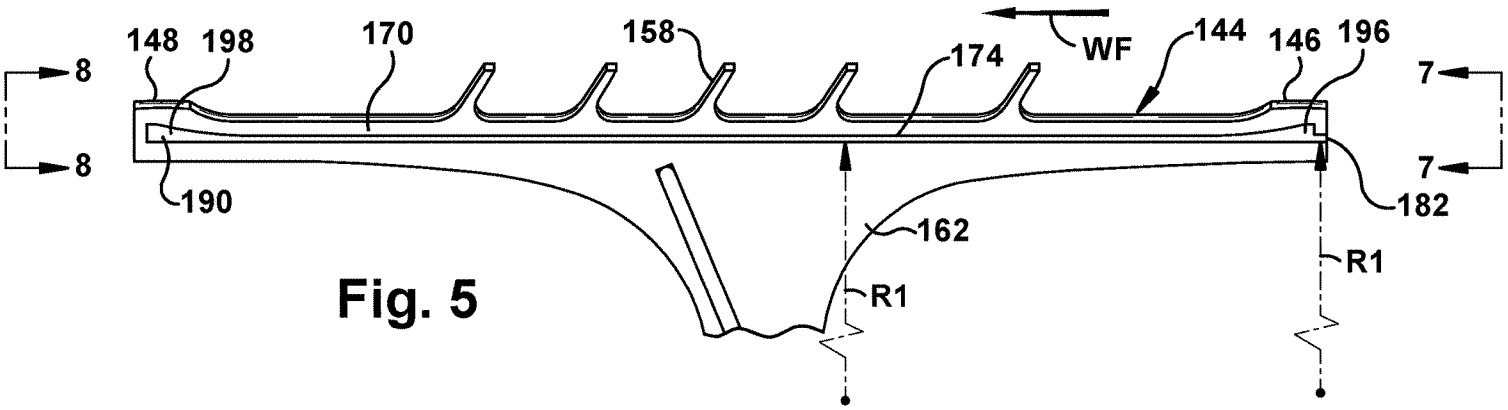
FIG. 5 shows a side view of a first slash face of the sealing member including a first spline seal slot.
Figure 6:
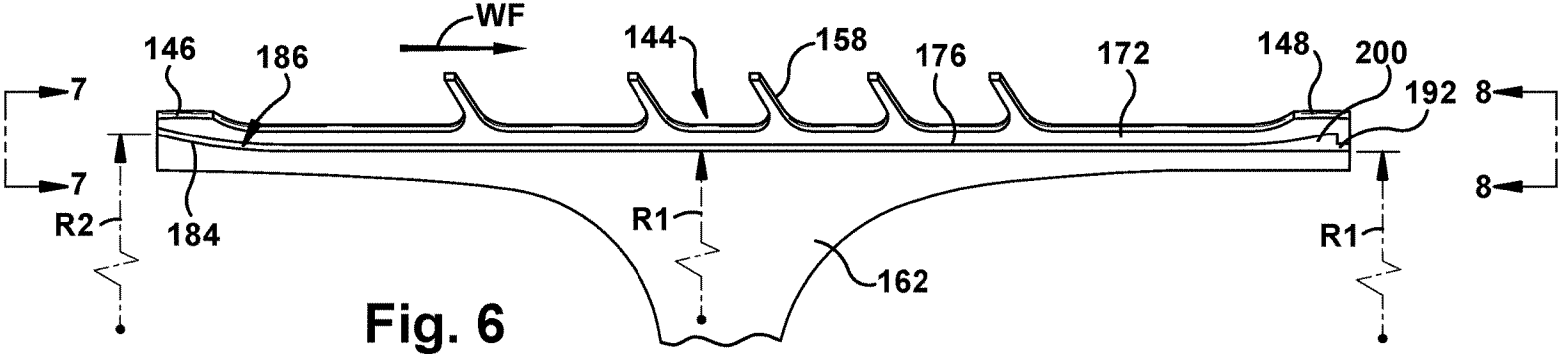
FIG. 6 shows a side view of a second, opposing slash face of the sealing member including a second spline seal slot that is different than the first spline seal slot.
Figure 8:
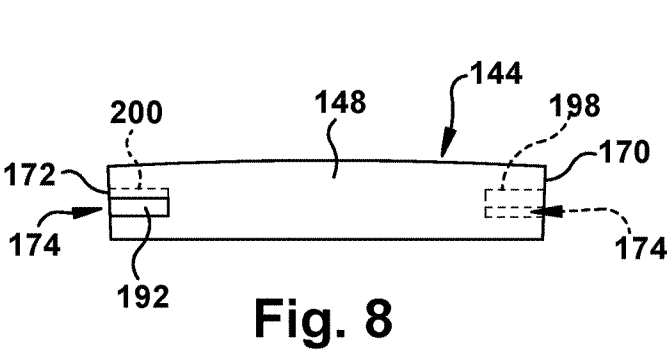
FIG. 8 shows an end view of an aft axial end of the axially extending sealing portion of the main sealing member.
Figure 7:
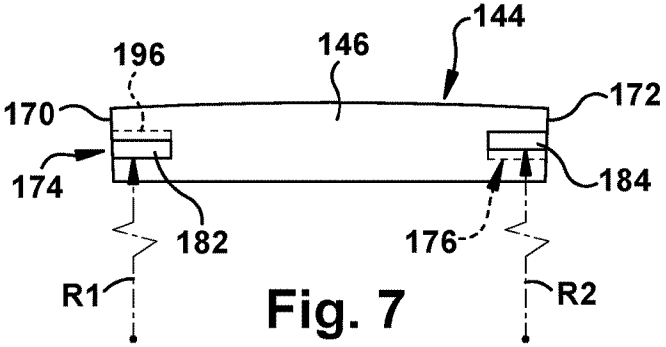
FIG. 7 shows an end view of a forward axial end of an axially extending sealing portion of a main sealing member.

FIGS. 4-8 show views of main sealing member 142 for purposes of introducing spline seal-receiving slots ("spline seal slots," "spline slots") 174, 176. FIG. 5 shows a side view of first slash face 170, and FIG. 6 shows a side view of second slash face 172, on the same axial sealing portion 144 of an illustrative first, main sealing member 142. That is, FIGS. 5 and 6 show opposing slash faces 170, 172 of the same main sealing member 142. FIG. 7 shows an end view of forward axial end 146 of axial sealing portion 144, and FIG. 8 shows an end view of aft axial end 148 of axial sealing portion 144, of the same main sealing member 142.

In certain embodiments of main sealing members 142, as shown in FIGS. 4 and 5, a first stationary slot 174 is defined in first slash face 170, and as shown in FIG. 6, a second spline seal slot 176 is defined in second, opposing slash face 172. Slots 174, 176 are not the same. As will be described herein, spline seal slots 174, 176 cooperate to position a spline seal 180 (FIG. 4) therein in an operative axial position (FIGS. 19-23) of adjacent sealing members to seal the adjacent sealing member together. In addition, spline seal slots 174, 176 are structured to allow insertion of spline seal 180 into facing slots 174, 176 on adjacent sealing members 142, 210, 212, when the sealing members are in an axially offset position, and to retain spline seal 180 in facing spline seal slots 174, 176, when the adjacent sealing members are moved to an operative axial position (FIGS. 19-23). Generally, spline seal slot 174 allows initial sliding of spline seal 180 into the slot, and then retains spline seal 180 therein as the sealing member in which it is positioned is held stationary and the adjacent sealing member moves from the axially offset position to the operative axial position. Hence, spline seal slot 174 may be referred to herein for differentiation purposes as "stationary slot 174." Generally, spline seal slot 176 allows initial sliding of spline seal 180, and then allows adjustment of the position of spline seal 180 therein as the sealing member in which it is positioned moves from the axially offset position to the operative axial position. Hence, spline seal slot 176 may be referred to herein for differentiation purposes as a "moving slot 176." As will be described herein, main sealing members 142 include a stationary slot 174 on one slash face 170, and a moving slot 176 on the opposing slash faces 172. In contrast, initiator sealing member 210 includes stationary slot 174 on both slash faces 170, 172 thereof, and locking sealing member 212 includes moving slot 176 on both slash faces 170, 172, thereof. In any event, slots 174, 176 may have any desired circumferential dimension (into page in FIGS. 5-6) to allow seating of spine seal 180 therein, and prevent circumferential gaps of spine seal 180 relative to slash faces 170, 172. Spine seal 180 and slots 174, 176 can also have any length desired, typically a similar length to that of axial sealing portion 144 in which positioned.

As shown in FIG. 5, stationary slot 174 includes a first spline seal-entry opening 182 defined through forward axial end 146 of axial sealing portion 144. First spline seal-entry opening 182 in first slash face 170 couples in a linearly contiguous manner with a remainder of stationary slot 174 defined in first slash face 170. Similarly, moving slot 176 includes a second spline seal-entry opening 184 defined through forward axial end 146 of axial sealing portion 144. As shown best in FIG. 7, first spline seal-entry opening 182 is at a first radial position R1 that is different from a second radial position R2 of second spline seal-entry opening 184. Radial positions R1, R2 can have, for example, axis A of turbomachine 100 (FIG. 1) as a reference point, as described herein, or other fixed structure of turbine 111. In the example shown in FIG. 7, second spline seal-entry opening 184 is radially outside of first spline seal-entry opening 182, i.e., R2>R1. FIG. 6 shows second spline seal-entry opening 184 couples to a remainder of moving slot 176 defined in second slash face 172 by a contiguous curved slot portion 186 defined in second slash face 172. Curved slot portion 186 thus positions second spline seal-entry opening 184 in second slash face 172 at the larger radial position R2, but transitions smoothly to a remainder of moving slot 176 defined in second slash face 172 (which is at first radial position R1), allowing spline seal 180 to slide smoothly therein. The remainder of moving slot 176 (downstream of curved slot portion 186) and all of stationary slot 174 generally has the same radial position, i.e., first radial position R1.

As shown in FIGS. 5 and 8, stationary slot 174 in first slash face 170 includes a closed end 190 at aft axial end 148 of axial sealing portion 144. Thus, spline seal 180 cannot escape through aft axial end 148 of slot 174. In contrast, as shown in FIGS. 6 and 8, moving slot 176 in second slash face 172 includes a spline seal passthrough opening 192 defined through aft axial end 148 of axial sealing portion 144. Spline seal passthrough opening ("passthrough opening") 192 is radially aligned with stationary slot 174 defined in first slash face 170, i.e., in an adjacent sealing member. In this manner, spline seal 180 can slide through passthrough opening 192 while engaged in retaining slot 174 and entry slot 176 of an adjacent seal member.

As shown in FIG. 4, in certain embodiments, spline seal 180 may include a planar body 218 with opposing ends ("ends," "seal ends") 194, 195. As will be described, ends 194, 195 may act to position and retain spline seal 180 in slots 174, 176. As shown in FIGS. 5 and 6, stationary slot 174 in first slash face 170 may include a first spline seal end-retaining seat ("first seal seat," "seal seat") 196 in forward axial end 146 of axial sealing portion 144. Stationary slot 174 also may include a second spline seal end-retaining seat ("second seal seat," "seal seat") 198 in aft axial end 148 of axial sealing portion 144. As shown in FIG. 5, first spline seal-entry opening 182 is contiguous with first seat 196, i.e., they are connected. As shown in FIG. 6, moving slot 176 in second slash face 172 may also include a third spline seal end-retaining seat ("third seal seat," "seal seat") 200 in aft axial end 148 of axial sealing portion 144. Passthrough opening 192 is contiguous with third seat 200, i.e., they are connected. Forward axial end 146 of second slash face 172 is devoid of a spline seal end-retaining seat because it includes curved slot portion 186. Each seal seat 196, 198, 200 includes an enlarged opening that is contiguous with its respective slot 174, 176. As will be described further, seal seats 196, 198 allow respective ends 194, 195 to be seated and retained therein when spline seal 180 is installed, and seal seat 200 allows end 195 to be seated therein when spline seal 180 is exposed to centrifugal load during operation. Curved slot portion 186 is circumferentially aligned with first seal seat 196 in forward axial end 146 of stationary slot 174 in axial sealing portion 144. In this manner, even though forward end 194 of spline seal 180 has limited movement when it is in curved slot portion 186 (i.e., it cannot flex or move radially), curved slot portion 186 can direct forward end 194 of spline seal 180 into seal seat 196 in stationary slot 174 adjacent to curved slot portion 186. This positioning can occur when forward end 194 is not restrained within first spline seal-entry opening 182. In this manner, although not axially restrained in curved slot portion 186 in moving slot 176, spline seal 180 can be retained in slots 174, 176 by first seat 196 in moving slot 176.

As noted herein, sealing assembly 140 includes a plurality of sealing members 142 configured to be located adjacent one another between adjacent rotating blade stages 124 (FIG. 3) in turbine 111 (FIG. 3). FIG. 9 shows an end view of forward axial ends 146 of a portion of sealing assembly 140 in an operative state. The portion of sealing assembly 140 illustrated includes sealing members located where the actual assembling of sealing assembly 140 begins and terminates. In addition to main sealing members 142, as noted previously, sealing assembly 140 also includes a second, initiator sealing member 210 and a third, locking sealing member 212. Sealing members 210, 212 are substantially similar to sealing members 142 except the types of slots providing therein are the same on both slash face surfaces 170, 172 thereof. As will be described further herein, the provision of the same slots 174, 176 on both slash faces 170, 172 of sealing members 210, 212 accommodates starting of the assembling and termination of the assembling of sealing assembly 140.

Figure 10:
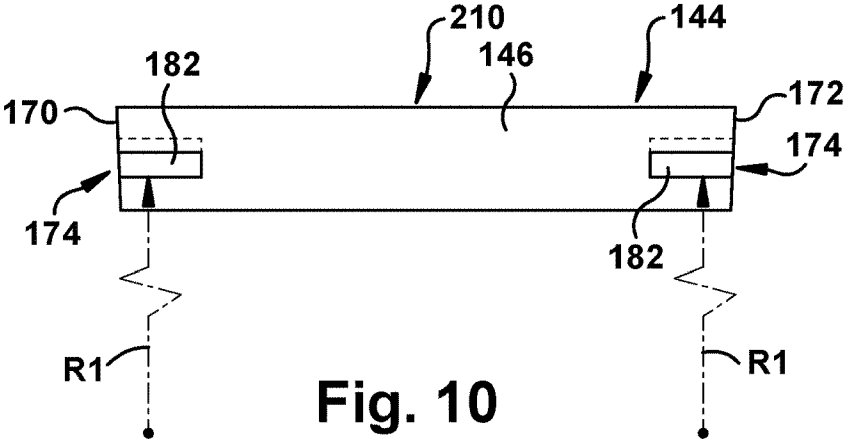
FIG. 10 shows an end view of a forward axial end of an axially extending sealing portion of an initiator sealing member.

As shown in FIG. 9, initiator sealing member 210 is configured to be located adjacent one of main sealing members 142 (left as shown) and locking sealing member 212 (right as shown). Initiator sealing member 210 includes the same structure as main sealing members 142 except for its slots. As shown in FIG. 4, initiator sealing member 210 includes seal base 162 including retention mechanism 166 operative to secure to inter-stage support structure 164. Initiator sealing member 210 also includes axial sealing portion 144 coupled to seal base 162. Axial sealing portion 144 has axial ends 146, 148, and slash faces 170, 172, and extends between axial ends 146, 148. FIG. 10 shows an enlarged end view of forward axial end 146 of initiator sealing member 210. Here, stationary slots 174 (as in FIG. 5) are provided on both slash faces 170, 172, with the slots being mirror images of one another. Thus, as shown in FIG. 10, forward axial end 146 of initiator sealing member 210 has two stationary slots 174, with both slots including spline seal-entry opening 182 defined through forward axial end 146 of axial sealing portion 144. Both openings 182 have first radial distance R1. That is, in initiator sealing member 210, spline seal-entry opening 182 (left side FIG. 10) and spline seal-entry opening 182 (right side FIG. 10) are both at, for example, first radial position R1. As shown in FIG. 7, first radial position R1 is different from second radial position R2 of spline seal-entry opening 184 in slash face 172 in main sealing members 142. As shown in FIG. 9, one of stationary slots 174 (left side of initiator sealing member 210 as shown) cooperate to retain spline seal 180 therein in an operating position with a respective stationary slot 174 of adjacent first, main sealing member 142. The other stationary slot 174 (right side of initiator sealing member 210 as shown) cooperates to retain spline seal 180 therein in an operating position thereof with a respective moving slot 176 of adjacent locking sealing member 212.

With continuing reference to FIG. 9, locking sealing member 212 is configured to be located between one of main sealing members 142 (to right thereof as shown) and initiator sealing member 210 (left thereof as shown). As illustrated, main sealing members 142 are assembled in a counterclockwise direction when looking in the direction of the fluid flow path, i.e., aft as in FIG. 9. In this configuration, the main sealing member is to the right of lacking sealing member 212, a last one (last assembled) main sealing member 142F. As shown in FIG. 4, locking sealing member 212 includes the same structure as sealing members 142, 210 except for its slots. Locking sealing member 212 includes seal base 162 including retention mechanism 166 operative to secure to inter-stage support structure 164. Locking sealing member 212 also includes axial sealing portion 144 coupled to seal base 162. Axial sealing portion 144 has forward and aft axial ends 146, 148, and slash faces 170, 172, which extends between axial ends 146, 148.

FIG. 11 shows an enlarged end view of forward axial end 146 of initiator sealing member 210. Here, moving slots 176 (as in FIG. 6) are provided on both slash faces 170, 172, as shown in FIG. 11, with the slots being mirror-images of one another. Thus, as shown in FIG. 11, forward axial end 146 of locking sealing member 212 has two stationary slots 176, with both slots including spline seal-entry opening 184 defined through forward axial end 146 of axial sealing portion 144. Both openings 184 have, for example, second radial position R2. That is, in locking sealing member 212, spline seal-entry opening 184 (left side FIG. 11) and spline seal-entry opening 184 (right side FIG. 11) are at, for example, second radial position R2. As shown in FIG. 7, first radial position R1 is different than second radial position R2 of spline seal-entry opening 184 in main sealing members 142. As shown in FIG. 9, one of moving slots 176 (right side of locking sealing member 212 as shown) cooperates to retain spline seal 180 therein in an operating position thereof with a respective stationary slot 174 of adjacent main sealing member 142F (right side as shown). The other moving slot 176 (left side of locking sealing member 212 as shown) cooperates to retain spline seal 180 therein in an operating position with a respective stationary slot 174 of adjacent initiator sealing member 210.

Sealing assembly 140 may also include spline seal 180 within seal slots 174, 176 of adjacent sealing members 142, 210, 212. As noted, each spline seal 180 includes planar body 218 having a forward end 194 and an opposing, aft end 195. As will be further described, at least one of opposing ends 194, 195 is retained in one of seal seats 196, 198, 200 in the relaxed state.

Each sealing member 142, 210, 212 may have any circumferential extent desired, e.g., 5°, 10°, 15°, etc. The number of sealing members 142, 210, 212 may depend on a number of factors such as but not limited to: the diameter of turbine 111, the diameter of a particular blade stage 124 in which employed, the desired number of sealing members, etc.

FIGS. 12-23 show embodiments of a method of assembling sealing assembly 140 with a plurality of sealing members configured to be located adjacent one another between adjacent rotating blade stages 124 (FIG. 2) of turbine 111 (FIG. 2). For purposes of description of the assembly of sealing members into sealing assembly 140, sealing members mounted first in the operative axial position are labeled "A", and a next-in-line sealing member to be mounted is labeled "B". Similarly named parts on each sealing member are also referenced with an "A" designation or a "B" designation, e.g., forward axial ends 146A, 146B. For purposes of description, it is assumed assembly progresses counter-clockwise looking aft at turbine 111, see direction of assembly arrow (DA) in FIGS. 9, 12, 13, 15, 16, and 19. It will be recognized that assembly can proceed in the opposite direction also.

Figure 12:
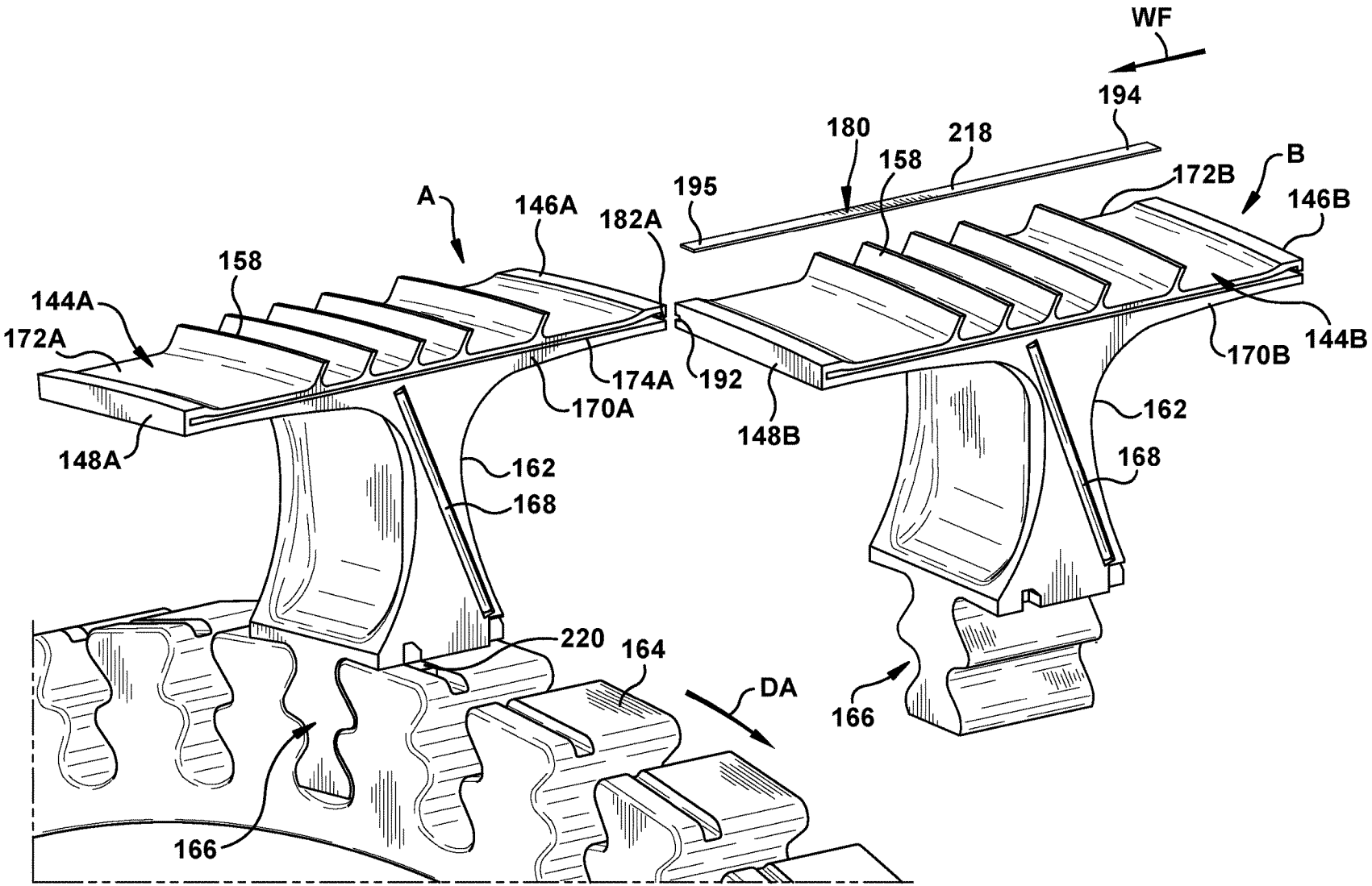
FIG. 12 shows a perspective view of an initial arrangement for a method of assembling the sealing assembly including an initiator or previous main sealing member in an operative axial position.

FIG. 12 shows a perspective view of positioning a first sealing member A in an inter-stage support structure 164 in an operative axial position of the plurality of sealing members. The "operative axial position" is a position in inter-stage support structure 164 in which the sealing member will remain during operation of turbine 111. In certain embodiments, axial facing surfaces of retention mechanism 166 of a sealing member and inter-stage support structure 164 may be coplanar, or close to coplanar, in the operative axial position, but this is not necessary in all instances.

Embodiments of the disclosure may include just assembling main sealing members 142 about inter-stage support structure 164, e.g., where initiator sealing member 210 is already in position. However, embodiments of the disclosure may also include assembling sealing assembly 140 (FIG. 3) by first positioning initiator sealing member 210, then sequentially and repetitively positioning any required number of main sealing members 142, and finally, positioning locking sealing member 212. In FIG. 12, sealing member A first positioned in the operative axial position may be initiator sealing member 210 or a main sealing member 142. Where sealing member A first positioned in inter-stage support structure 164 is the actual first sealing member installed, it will be initiator sealing member 210. Where sealing member A is first positioned on inter-stage support structure 164 is post-assembly of initiator sealing member 210 (not shown in this case), it may be any main sealing member 142. That is, one main sealing member 142 is positioned next to initiator sealing member 210 (not shown in this case). Then, each subsequent main sealing member 142 is positioned in the operative axial position next to a previously-mounted main sealing member 142, until only locking sealing member 212 needs to be assembled.

Each sealing member 142, 210, 212 may be positioned in the operative axial position by axially sliding retention mechanism 166 and inter-stage support structure 166 together, e.g., male retention mechanism 166 into corresponding female opening in inter-stage support structure 164. As shown in FIG. 12 and subsequent drawings, each sealing member 142, 210, 212 may be axially retained in inter-stage support structure 164 using any now known or later developed retention member 220, such as but not limited to a retention pin in a slot in inter-stage support structure 164 and seal base 162. As illustrated, sealing member A first positioned in the operative axial position includes a stationary slot 174A defined in first slash face 170A thereof (facing counterclockwise in FIG. 9). First slash face 170A includes stationary slot 174A including spline seal-entry opening 182A defined through forward axial end 146A of first axial sealing portion 144A of sealing member A.

Figures 13, 14:
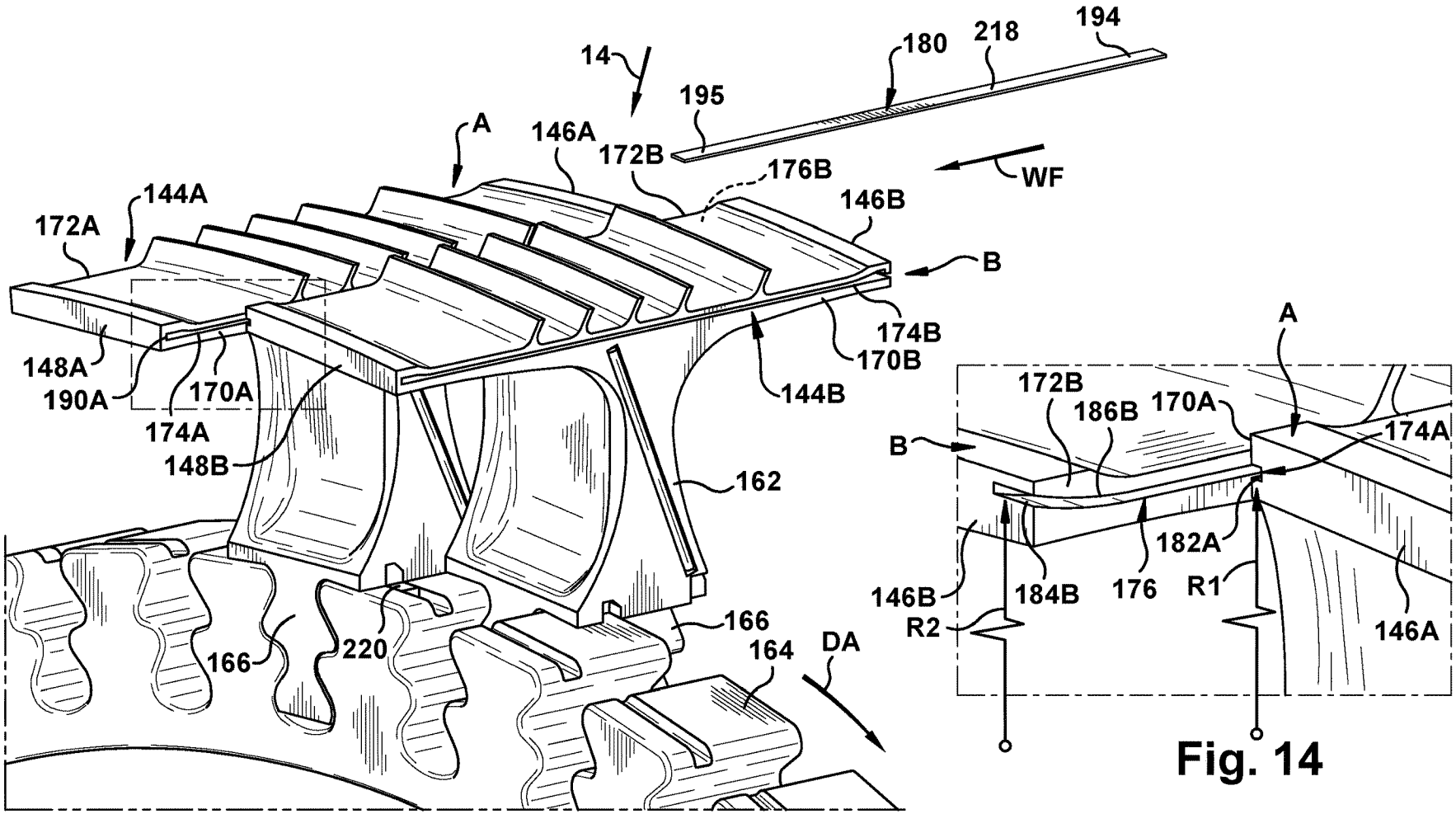
FIG. 13 shows a perspective view of positioning of a sealing member in an axially offset position during assembling of the sealing assembly.
FIG. 14 shows an enlarged perspective view along view line 14-14 in FIG. 13 of the interaction of spline seal slots of adjacent sealing members in the axially offset position.

FIG. 13 shows second positioning sealing member B in inter-stage support structure 164 in an axial offset position from the operative axial position. The "axial offset position" is a position that is only partially toward the operative axial position of the plurality of sealing members. Here, sealing member B is only partially installed in inter-stage support structure 164, and axial facing surfaces of retention mechanism 166 and inter-stage support structure 164 are not close to coplanar. Sealing member B includes moving slot 176 defined in second slash face 172 thereof. As shown in FIGS. 6 and 8, moving slot 176 includes second spline seal-entry opening 184 defined through forward axial end 146B (FIG. 13) of second axial sealing portion 144B of sealing member B.

FIG. 14 shows enlarged perspective views along view line 14 in FIG. 13 with sealing members in the offset axial position. As shown in FIG. 13 and especially FIG. 14, seal slots 174, 176 are aligned for receipt of spline seal 180 therein in the axially offset position of sealing member B. More specifically, spline seal-entry opening 184 of moving slot 176 is at second radial position R2, but is axially forward of spline seal-entry opening 182A in sealing member A which is at first radial position R1. The rest of moving slot 176B in slash face 172B in sealing member B is radially aligned with stationary slot 174 in sealing member A. Hence, a spline seal 180 can be slid into spline seal-entry opening 184 of moving slot 176 to move into spline seal-entry opening 182 in sealing member A, despite the different radial positions of openings 182, 184. Hence, the axial offset position is also where a portion of moving slot 176 (in the being-mounted, axially offset sealing member B) that is axially downstream from curved slot portion 186B thereof is circumferentially aligned with spline seal-entry opening 182A of stationary slot 174A in the already mounted sealing member A.

Figure 15:
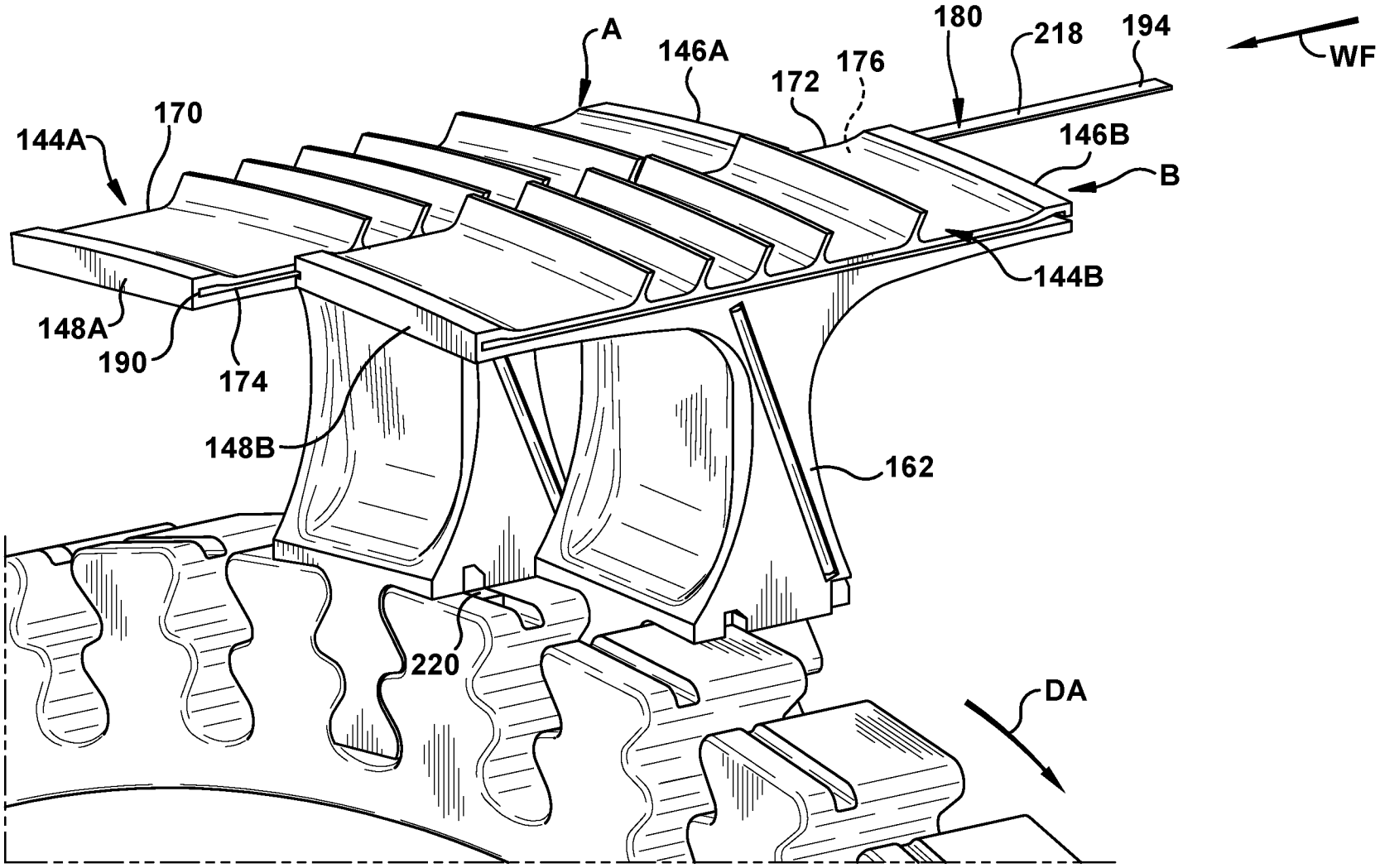
FIG. 15 shows a perspective view of initially inserting a spline seal within adjacent sealing members in the axially offset position during assembling of the sealing assembly.
Figure 16:
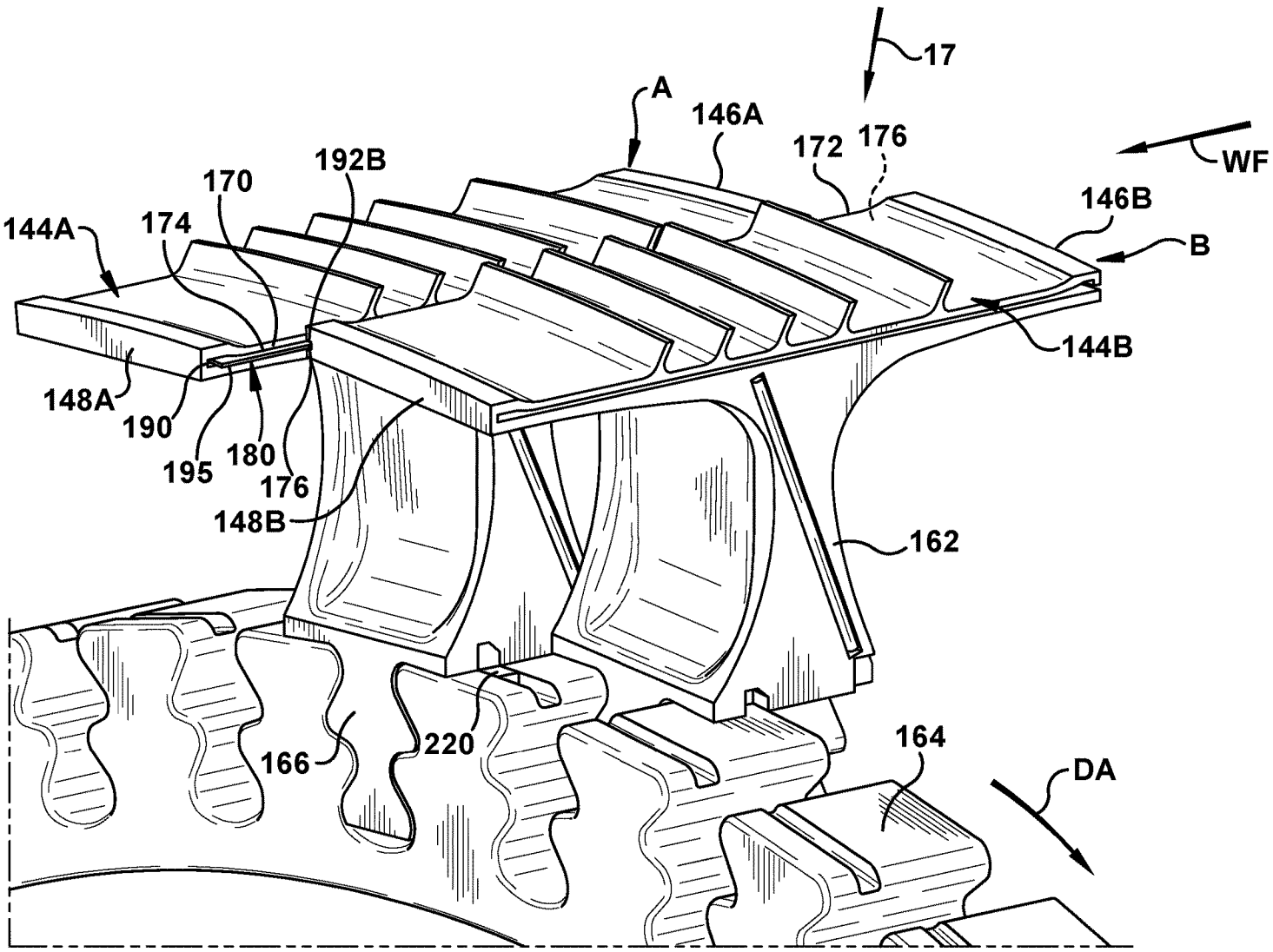
FIG. 16 shows a perspective view of the spline seal fully inserted within adjacent sealing members in the axially offset position during assembling of the sealing assembly.
Figure 18:
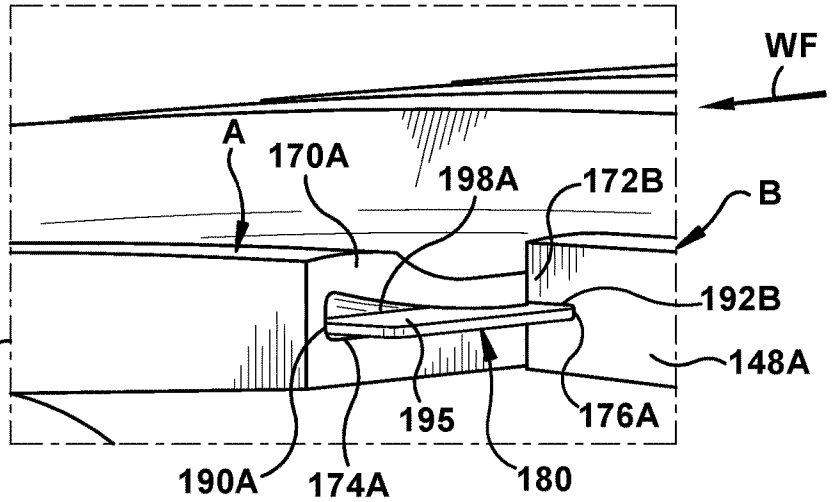
FIG. 18 shows an enlarged perspective view along view line 18 in FIG. 16 of the interaction of the spline seal and the spline seal slots of adjacent sealing members in the axially offset position.
Figure 17:
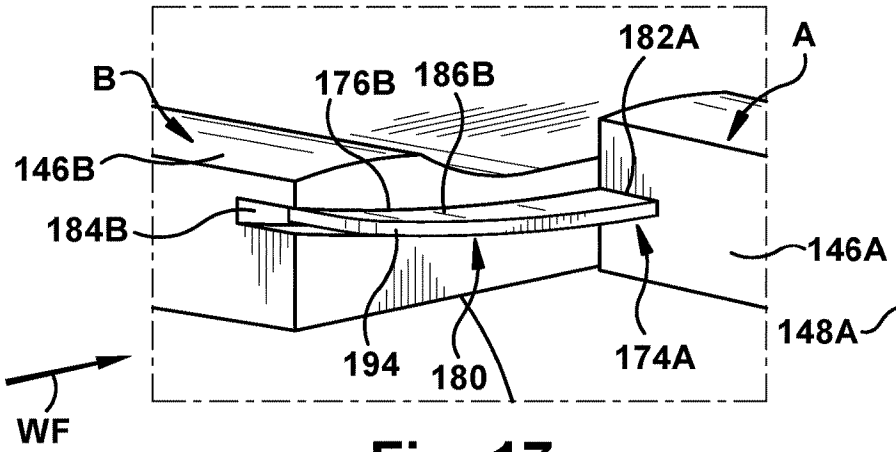
FIG. 17 shows an enlarged perspective view along view line 17 in FIG. 16 of the interaction of the spline seal and the spline seal slots of adjacent sealing members in the axially offset position.

At this stage, a spline seal 180 may be inserted into stationary and moving slots 174, 176. FIG. 15 shows a perspective view of sealing members A, B in the axially offset position and with a spline seal 180 starting to be slid into slots 174, 176; and FIG. 16 shows a perspective view of sealing members A, B with spline seal 180 slid into slots 174, 176 as far as possible in the axially offset position. FIG. 17 shows an enlarged perspective view along view line 17 in FIG. 16, and FIG. 18 shows an enlarged perspective view along view line 18 in FIG. 16. Both FIGS. 17 and 18 show the interaction of spline seal 180 and seal slots 174, 176 of adjacent sealing members A, B in the axially offset position.

As shown best in FIG. 17, spline seal 180 can be slid into opening 184B of moving slot 176B, along curved slot portion 186B and into opening 182A of stationary slot 174A. That is, spline seal 180 is slid into spline seal-entry opening 184B of moving slot 176B and moves into spline seal-entry opening 182A in sealing member A, despite the different radial positions of openings 182A, 184B. As shown in FIGS. 16 and 18, as spline seal 180 slides into slots 174A, 176B, it can extend out of sealing member B via spline seal passthrough opening 192B in aft axial end 148B of sealing member B. That is, in the axially offset position of sealing member B, spline seal 180 (aft end 195) extends through spline seal passthrough opening 192B defined through aft axial end 148B of axial sealing portion 144B. As noted, spline seal passthrough opening 192B is radially aligned with stationary slot 174A, allowing this positioning to occur. At the same time, as spline seal 180 slides into slots 174A, 176B, it slides through stationary slot 174A in sealing member A until it abuts closed end 190A thereof. Spline seal passthrough opening 192B is radially aligned with stationary slot 174A, and thus may prevent radially outward movement of aft end 195 of spline seal 180 into seal seat 198A in aft axial end 148A of sealing member A. When spline seal 180 reaches closed end 190A of stationary slot 174A, sliding of spline seal 180 stops. That is, spline seal 180 is retained in closed end 190A of stationary slot 174A in first slash face 170A at aft axial end 148B of axial sealing portion 144A.

Figure 21:
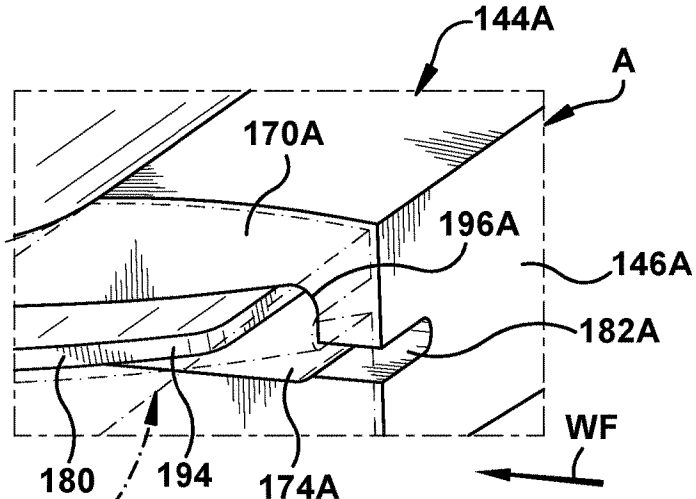
FIG. 21 shows an enlarged perspective view along view line 21 in FIG. 19 with a nearest sealing member removed from view, and showing the position of the spline seal in one of the spline seal slots in the operative axial position of the sealing members.
Figure 20:
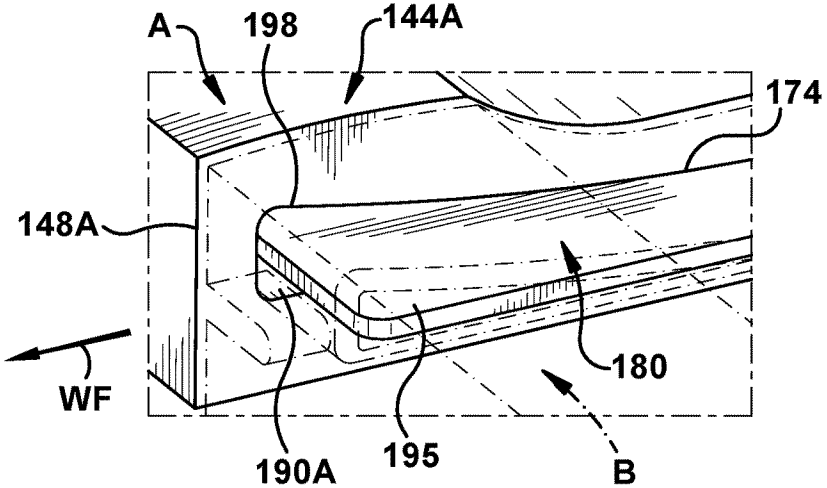
FIG. 20 shows an enlarged perspective view along view line 20 in FIG. 19 with a nearest sealing member removed from view, and showing the position of the spline seal in one of the spline seal slots in the operative axial position of the sealing members.
Figure 19:
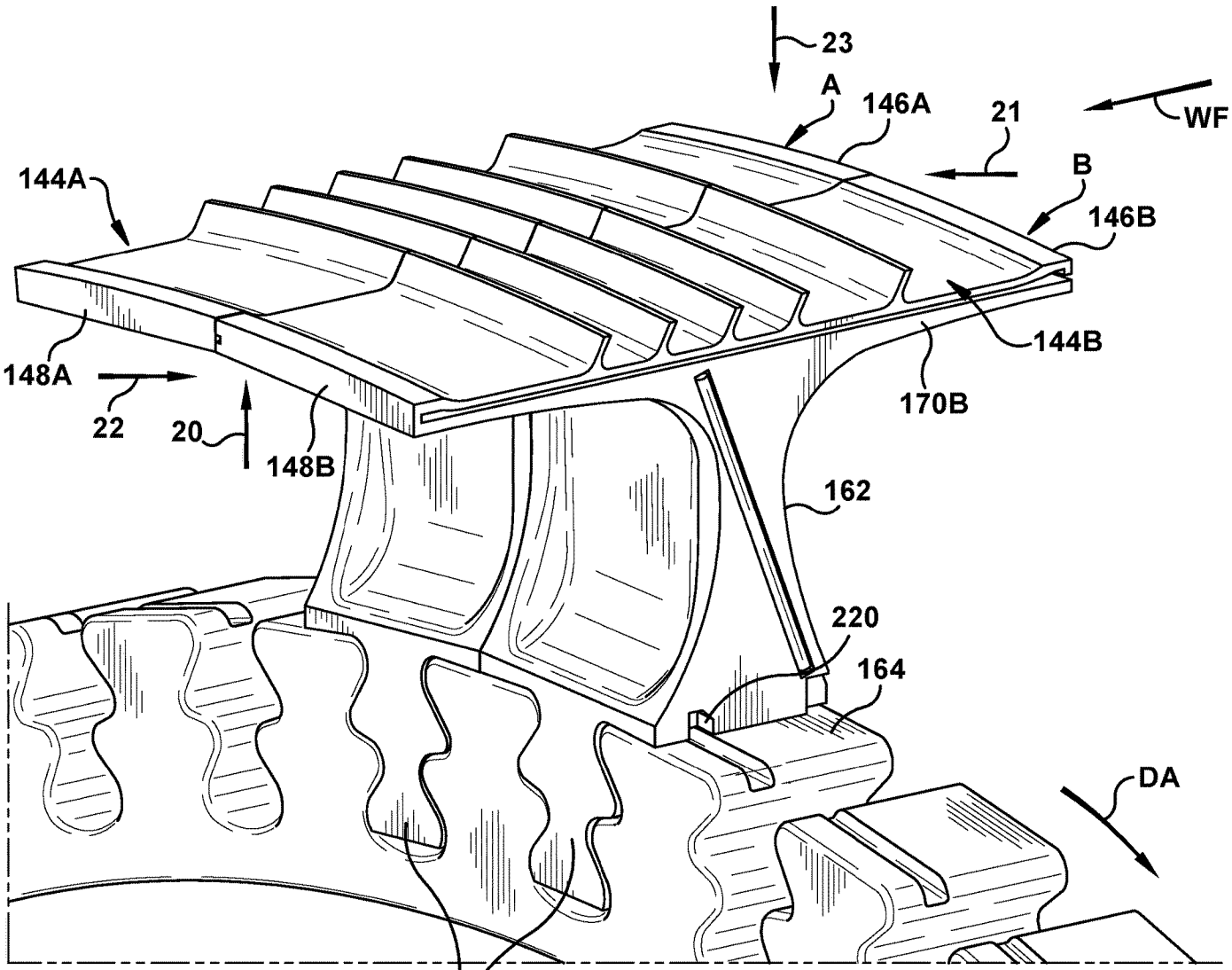
FIG. 19 shows a perspective view of positioning the sealing member in an operative axial position during assembling of the sealing assembly.
Figure 23:
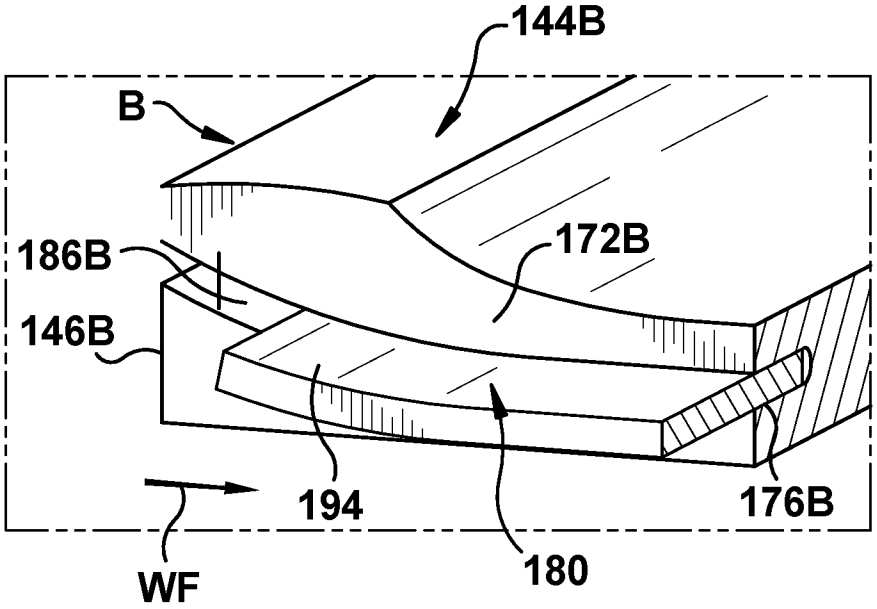
FIG. 23 shows an enlarged perspective view along view line 23 in FIG. 19 with a nearest sealing member removed from view, and showing the position of the spline seal in one of the spline seal slots in the axially aligned, operative axial position of the sealing members.
Figure 22:
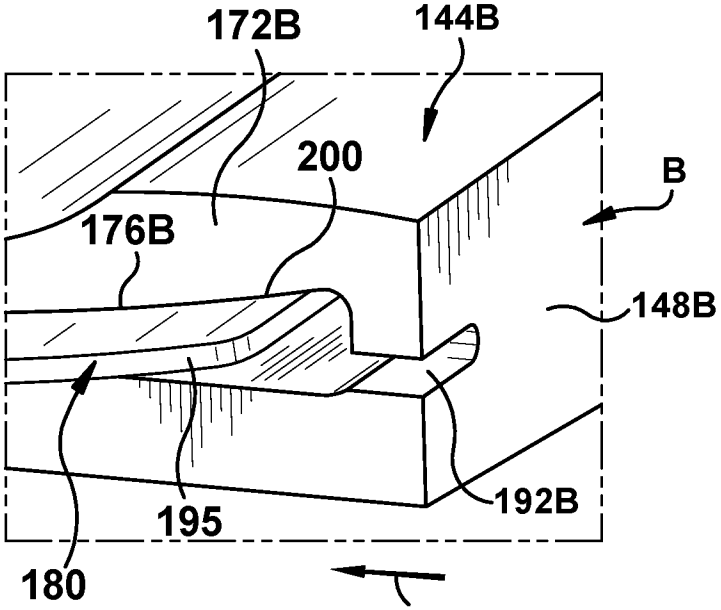
FIG. 22 shows an enlarged perspective view along view line 22 in FIG. 19 with a nearest sealing member removed from view, and showing the position of the spline seal in one of the spline seal slots in the operative axial position of the sealing members.

FIGS. 19-23 show perspective views after positioning sealing member B in inter-stage support structure 164 in the operative axial position of the plurality of sealing members. The positioning may include moving sealing member B further axially into inter-stage support structure 164. As shown in FIG. 19, with sealing member B in inter-stage support structure 164 in the operative axial position of the plurality of sealing members, it can be fixed in place by retention member 220. FIG. 20 shows an enlarged perspective view of aft axial end 148A of first sealing member A, but with sealing member B removed from view; and FIG. 21 shows an enlarged perspective view of forward axial end 146A of first sealing member A, but with sealing member B removed from view. Similarly, FIG. 22 shows an enlarged perspective view of aft axial end 148B of second sealing member B, but with sealing member A removed from view; and FIG. 23 shows an enlarged perspective view of forward axial end 146B of second sealing member B in the axial operative axial position, but with sealing member A removed from view.

As shown in the enlarged perspective view of FIGS. 20-23, the positioning of sealing member B in inter-stage support structure 164 in the operative axial position of the plurality of sealing members adjusts the position of spline seal 180 in moving slot 176B, and to a lesser degree, stationary slot 174A. More particularly, the adjustment of spline seal 180 relative to spline seal slots 174A, 176B allows the spline seal to be retained in an operating position of the spline seal in at least one spline seal-retaining seat 196A, 198A, 200A in at least one spline seal slot(s) 174A, 176B. For example, FIGS. 20 and 22 show an aft end 195 in seal seat 198A in stationary slot 174A and in seal seat 200B in moving slot 176B. As shown best in FIG. 22, after sealing member B is slid to the operative axial position, aft axial end 148B of axial sealing portion 144B slides over aft end 195 of spline seal 180, i.e., end 195 moves inwardly of aft axial end 146B out of spline seal passthrough opening 192. As this occurs, as shown in FIG. 20, end 195 of spline seal 180 is also held in position in closed end 190A of stationary slot 174A—spline seal 180 does not move despite sealing member B moving axially rearward (in direction of arrow WF) over it. As shown in FIG. 22, in the operative axial position of sealing member B, after end 195 is no longer restrained in spline seal passthrough opening 192. Circumferentially opposing seal seats 198A and 200B are configured such that once aft end 195 of spline seal 180 passes out of passthrough opening 192B in moving slot 176B, end 195 can move into seal seats 198A, 200B upon exposure to centrifugal forces during operation of turbine 100 to seal between opposing axial sealing portions 144A, 144B. Axial removal of spline seal 180 from aft axial ends 148A, 148B of sealing members A, B is prevented by closed end 190A. Hence, in the operative axial position and with application of centrifugal force, end 195 of spline seal 180 moves into seal seat 200B in aft axial end 148B of axial sealing portion 144B, and seal seat 198A in aft axial end 148A of axial sealing portion 144A. In this position, spline seal 180 seals between adjacent axial sealing portions 144A, 144B.

On the forward end of spline seal 180, as shown in FIG. 23, after sealing member B is slid to the operative axial position (see arrow WF), spline seal 180 slides inwardly along curved slot portion 186. Curved slot portion 186 is configured to be at least partially circumferentially opposite seal seat 196A (FIG. 21) in forward axial end 146A of sealing member A. Consequently, as sealing member B moves to the operative axial position, forward end 194 of spline seal 180 slides inwardly along curved slot portion 186B, and passes out of first spline seal-entry opening 182A defined through forward axial end 146A of axial sealing portion 144A. As shown in FIG. 21, forward end 194 of spline seal 180 is then able to move into seal seat 196A in stationary seal 174A, thus preventing removal of spline seal 180 from forward axial ends 146A, 146B of sealing members A, B. As shown in FIG. 23, forward end 194 of spline seal 180 may rest in curved slot portion 186B of moving slot 176B, which is shaped to allow end 194 to move into seal slot 196A (FIG. 21). Hence, simultaneously with seal seats 198A, 200B freely receiving aft end 195 of spline seal 180 and closed end 190A retaining spline seal 180, end 194 of spline seal 180 is retained in seat 196A in forward axial end 146A of axial sealing portion 144A. Spline seal 180 is thus retained from moving axially in either direction. Advantageously, spline seal 180 has not been exposed to any manipulation during its insertion or the positioning of seal members A, B that would cause damage to spline seal 180 or any sealing member, or any adjacent structure.

Any form of lubricant may be applied to slots 174, 176 and/or spline seal 180 to ensure proper sliding thereof. If spline seal 180 fails to slide into slots 174, 176 during the positioning of sealing member B, a tool (not shown) such as a flathead screwdriver may be inserted between slash faces 170, 172 to push spline seal 180 into the final position.

As noted, positioning of initiator sealing member 210 may occur before positioning any main sealing member 142. In this case, as shown in FIG. 12, the method may include positioning initiator sealing member 210 (sealing member A as shown in FIG. 12) in inter-stage support structure 164 in an axial position commensurate with the operative axial position of the plurality of sealing members. As noted, initiator sealing member 210 is configured to be positioned adjacent a first, main sealing member 142 (sealing member B in FIG. 12). As described relative to FIGS. 4, 9, 10 and 11, initiator sealing member 210 has stationary slots 174 on opposing slash faces 170, 172 thereof with spline seal-entry openings 182 in forward axial end 146 of axially extending seal portion 144 thereof. Each of spline seal-entry openings 182 of stationary slots 174 have the same radial position as one of first radial position R1 (as shown in FIG. 10) and second radial position R2.

As described relative to FIGS. 12-23, any number of main sealing members 142 may be sequentially positioned in inter-stage support structure 164 with a respective spline seal 180. That is, the positioning of sealing members 142 can be repeated as many times as necessary to form sealing assembly 140, excepting locking sealing member 212.

Figure 24:
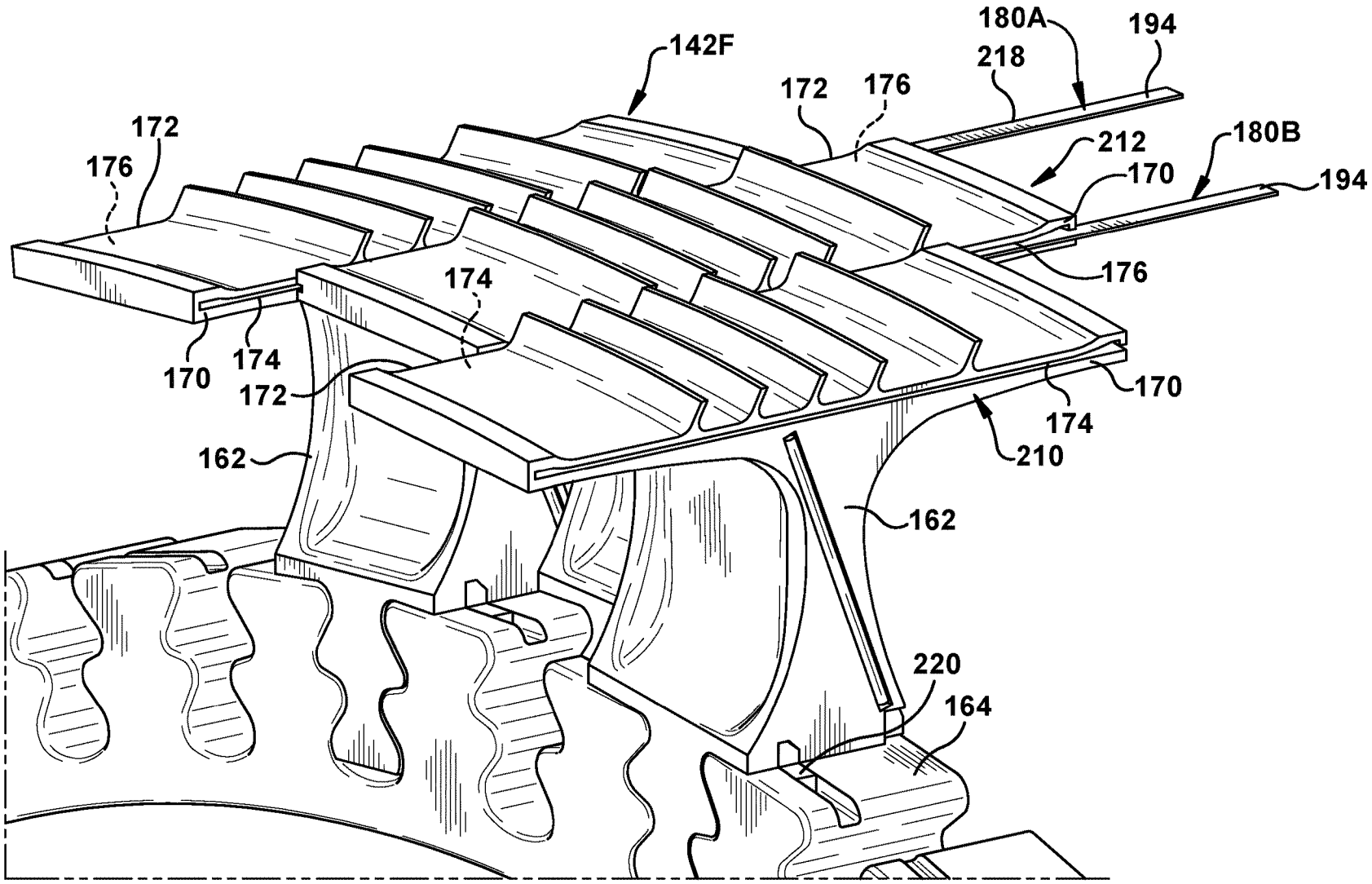
FIG. 24 shows a perspective view of positioning a locking sealing member with insertion of spline seals to complete the sealing assembly.

FIG. 24 shows a perspective view of positioning locking sealing member 212. The positioning of locking sealing member 212 occurs after a last one of main sealing members 142F (see also FIG. 9) is positioned in inter-stage support structure 164. That is, the positioning of locking sealing member 212 occurs after the repeated positioning of a number of main sealing members 142 to assembly sealing assembly 140, except for locking sealing member 212. FIG. 24 shows positioning locking sealing member 212 in an axial offset position for insertion of spline seals 180A and 180B, prior to positioning locking sealing member 212 in inter-stage support structure 164 in an axial position commensurate with the operative axial position of the plurality of sealing members (see FIG. 9). As noted, locking sealing member 212 is configured to be located between a last one of main sealing members 142F and initiator sealing member 210. As noted, locking sealing member 212 has moving slots 176 on both opposing slash faces 170, 172 thereof. As shown in FIG. 11, each of spline seal-entry openings 184 in forward axial end 146 of axially extending seal portion 144 have the same radial position as the other one of first radial position R1 and second radial position R2 (shown in FIG. 11) in initiator sealing member 210. Here, since initiator sealing member 210 has stationary slots 174 having first radial positions R1 (FIG. 10), each of spline seal-entry openings 184 in forward axial end 146 of axially extending seal portion 144 have second radial position R2 (FIG. 11). In this manner, locking sealing member 212 has its first slash face 170 having moving slot 176 that can mate with stationary slot 174 in first slash face 170 of the last one of main sealing members 142F. Its second slash face 172 having moving slot 176 can mate with stationary slot 174 in second slash face 172 of initiator sealing member 210.

Once in the axially offset position between the last one of main sealing members 142F and initiator sealing member 210, a spline seal 180A, 180B can be inserted into moving slots 176 of locking sealing member 212. More particularly, spline seal 180A can be inserted into moving slot 176 defined in second slash face 172 of locking sealing member 212 and in mating stationary slot 174 defined in first slash face 170 of the last one of main sealing members 142F. Similarly, spline seal 180B can be inserted into moving slot 176 defined in first slash face 170 of locking sealing member 212 and mating stationary slot 174 defined in second slash face 172 of initiator sealing member 210.

Once inserted, as shown in FIG. 9, locking sealing member 212 may be positioned in inter-stage support structure 164 into the operative axial position of the plurality of sealing members. The positioning positions both spline seals 180A, 180B into seal slot(s) 176 of locking sealing member 212. In addition, the positioning retains spline seals 180A, 180B in the operating position thereof in at least one seal seat 196, 198, 200 in at least one of the spline seal slots 174, 176, i.e., of locking sealing member 212, last main sealing member 142F and/or initiator sealing member 210. Thus, spline seals 180A, 180B are both retained in the operating position of the spline seals in between adjacent sealing members, as described relative to FIGS. 12-23. As shown in FIG. 9, positioning of locking sealing member 212 completes the rim of sealing assembly 140, and thus completes sealing assembly 140.

It will be recognized that while main sealing members 142 have been described herein as including stationary slot 174 on first slash face 170, and moving slot 176 on the opposing, second slash face 172, the slot positions can be switched. That is, main sealing members 142 would include stationary slot 174 on second slash face 172 (facing clockwise in FIG. 9 rather than counterclockwise as shown), and moving slot 176 on the opposing, first slash face 170 (facing counterclockwise in FIG. 9 rather than clockwise as shown). If this option was employed, initiator sealing member 210 would include moving slots 176 on both slash faces 170, 172 thereof, and locking sealing member 212 would include stationary slots 174 on both slash faces 170, 172 thereof, to accommodate the switch.

Spline seal 180 can be removed from between axial sealing portions 144A, 144B by reversing the described process. Here, a tool may be employed to move end 194 radially out of slot 196A such that end 194 can slide through spline seal-entry opening 182A defined through forward axial end 146A of first axial sealing portion 144A of sealing member A. In addition, a tool may be employed to move end 195 radially such that end 195 can slide through spline seal passthrough opening 192B in aft axial end 146B of sealing member B. Once spline seal ends 194, 195 are so positioned, axial sealing portion 144B can be slid out of the axial operative position over spline seal 180, and spline seal 180 can be slid out of stationary slot 174 and moving slot 176. The process can repeat for each sealing member.

Embodiments of the disclosure allow easy assembly of the sealing assembly with proper positioning of the spline seal, and without damaging the spline seal, the sealing members or adjacent structure. The sealing assembly does not require additional parts compared to conventional systems, and does not require any other changes to the turbine, thus allowing application to both new and older turbines.

The foregoing drawings show some of the processing associated according to several embodiments of this disclosure. In this regard, each drawing or block within a flow diagram of the drawings represents a process associated with embodiments of the method described. It should also be noted that in some alternative implementations, the acts noted in the drawings or blocks may occur out of the order noted in the figure or, for example, may in fact be executed substantially concurrently or in the reverse order, depending upon the act involved. Also, one of ordinary skill in the art will recognize that additional blocks that describe the processing may be added.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A plurality of sealing members for a sealing assembly, configured to be located adjacent one another between adjacent rotating blade stages of a turbine, wherein each sealing member comprises:

a seal base including a securing mechanism operative to secure to an inter-stage support structure;

an axially extending sealing portion coupled to the seal base, the axially extending sealing portion having a first axial end and an opposing, second axial end, and a first slash face and an opposing second slash face, wherein each slash face extends between the first axial end and the opposing, second axial end;

a first spline seal slot defined in the first slash face, the first spline seal slot including a first spline seal-entry opening defined through the first axial end of the axially extending sealing portion; and a second spline seal slot defined in the second slash face, the second spline seal slot including a second spline seal-entry opening defined through the first axial end of the axially extending sealing portion, wherein the first spline seal-entry opening is at a first radial position that is different than a second radial position of the second spline seal-entry opening, and wherein the first spline seal slot of a first seal member of the plurality of seal members and the second spline seal slot of a second, adjacent sealing member in the sealing assembly including the plurality of sealing members cooperate to retain a spline seal therein in an operating position thereof.

2. The plurality of sealing members of claim 1, wherein the first spline seal slot in the first slash face includes a closed end at the second axial end of the axially extending sealing portion.

3. The plurality of sealing members of claim 1, wherein the second spline seal slot in the second slash face includes a spline seal passthrough opening defined through the second axial end of the axially extending sealing portion, wherein the spline seal passthrough opening is radially aligned with the first spline seal slot defined in the first slash face.

4. The plurality of sealing members of claim 1, wherein the first spline seal slot in the first slash face includes a first spline seal end-retaining seat in the first axial end of the axially extending sealing portion, and a second spline seal end-retaining seat in the second axial end of the axially extending sealing portion, wherein the first spline seal-entry opening is contiguous with the first spline seal end-retaining seat, and wherein the second spline seal slot in the second slash face includes a third spline seal end-retaining seat in the second axial end of the axially extending sealing portion.

5. A sealing assembly, comprising:

a plurality of first sealing members configured to be located adjacent one another between adjacent rotating blade stages in a turbine, wherein each first sealing member includes:

a first seal base including a first securing mechanism operative to secure the sealing member to an inter-stage support structure;

a first axially extending sealing portion coupled to the first seal base, the first axially extending sealing portion having a first axial end and an opposing, second axial end, and a first slash face and an opposing second slash face, wherein each slash face extends between the first axial end and the opposing, second axial end;

a first spline seal slot defined in the first slash face, the first spline seal slot including a first spline seal-entry opening defined through the first axial end of the first axially extending sealing portion; and a second spline seal slot defined in the second slash face, the second spline seal slot including a second spline seal-entry opening defined through the first axial end of the first axially extending sealing portion, wherein the first spline seal-entry opening is at a first radial position that is different than a second radial position of the second spline seal-entry opening, and wherein the first spline seal slot and the second spline seal slot of adjacent sealing members cooperate to retain a spline seal therein in an operating position.

6. The sealing assembly of claim 5, wherein the first spline seal slot in the first slash face includes a closed end at the second axial end of the axially extending sealing portion.

7. The sealing assembly of claim 5, wherein the second spline seal slot in the second slash face includes a spline seal passthrough opening defined through the second axial end of the axially extending sealing portion, wherein the spline seal passthrough opening is radially aligned with the first spline seal slot defined in the first slash face.

8. The sealing assembly of claim 5, wherein the first spline seal slot in the first slash face includes a first spline seal end-retaining seat in the first axial end of the first axially extending sealing portion, and a second spline seal end-retaining seat in the second axial end of the first axially extending sealing portion, wherein the first spline seal-entry opening is contiguous with the first spline seal end-retaining seat.

9. The sealing assembly of claim 8, wherein the second spline seal slot in the second slash face includes a third spline seal end-retaining seat in the second axial end of the first axially extending sealing portion.

10. The sealing assembly of claim 9, wherein the second spline seal-entry opening in the second slash face couples to a remainder of the second spline seal slot defined in the second slash face by a contiguous curved slot portion defined in the second slash face.

11. The sealing assembly of claim 10, wherein the contiguous curved slot portion is circumferentially aligned with the third spline seal end-retaining seat in the second axial end of the first axially extending sealing portion.

12. The sealing assembly of claim 8, further comprising a spline seal within spline seal slots of adjacent sealing members, each spline seal including a planar body having opposing ends angled relative to the planar body in a relaxed state, wherein at least one of the opposing ends is retained in one of the spline seal end-retaining seats in the relaxed state.

13. The sealing assembly of claim 12, wherein the first spline seal-entry opening in the first slash face couples in a linearly contiguous manner with a remainder of the first spline seal slot defined in the first slash face.

14. The sealing assembly of claim 5, further comprising:

a second sealing member configured to be located adjacent one of the first sealing members, the second sealing member including:

a second seal base including a second securing mechanism operative to secure to the inter-stage support structure;

a second axially extending sealing portion coupled to the second seal base, the second axially extending sealing portion having a third axial end and an opposing, fourth axial end, and a third slash face and an opposing fourth slash face, wherein each of the third and fourth slash faces extends between the third axial end and the opposing, fourth axial end; and a third spline seal slot defined in the third slash face, the third spline seal slot including a third spline seal-entry opening defined through the third axial end of the second axially extending sealing portion;

a fourth spline seal slot defined in the fourth slash face, the fourth spline seal slot including a fourth spline seal-entry opening defined through the third axial end of the second axially extending sealing portion, wherein the third spline seal-entry opening and the fourth spline seal-entry opening are at the first radial position that is different than the second radial position of the second spline seal-entry opening, and wherein one of the third spline seal slot and the fourth spline seal slot cooperates to retain a spline seal therein in an operating position with a respective spline seal slot of the adjacent first sealing member.

15. The sealing assembly of claim 14, further comprising:

a third sealing member configured to be located between one of the first sealing members and the second sealing member, the third sealing member including:

a third seal base including a third securing mechanism operative to secure to the inter-stage support structure;

a third axially extending sealing portion coupled to the third seal base, the third axially extending sealing portion having a fifth axial end and an opposing, sixth axial end, and a fifth slash face and an opposing sixth slash face, wherein each of the fifth and sixth slash faces extends between the fifth axial end and the opposing, sixth axial end; and a fifth spline seal slot defined in the fifth slash face, the fifth spline seal slot including a fifth spline seal-entry opening defined through the fifth axial end of the third axially extending sealing portion;

a sixth spline seal slot defined in the sixth slash face, the sixth spline seal slot including a sixth spline seal-entry opening defined through the sixth axial end of the third axially extending sealing portion, wherein the fifth spline seal-entry opening and the sixth spline seal-entry opening are at the second radial position of the second spline seal-entry opening, and wherein one of the fifth spline seal slot and the sixth spline seal slot cooperates to retain a spline seal therein in an operating position with a respective spline seal slot of the adjacent first sealing member.

* * * * *